US012721407B2

(12) United States Patent
Jaliwala

(10) Patent No.: US 12,721,407 B2
(45) Date of Patent: Sep. 1, 2026

(54) SEGMENTED ROLL RESISTANT NECKLACE SYSTEM

(71) Applicant: Jewelex New York, Ltd., New York, NY (US)

(72) Inventor: Khaiyam Jaliwala, Mumbai (IN)

(73) Assignee: Jewelex New York, Ltd., New York, NY (US)

( * ) Notice: Subject to any disclaimer, the term of this patent is extended or adjusted under 35 U.S.C. 154(b) by 54 days.

(21) Appl. No.: 18/602,577

(22) Filed: Mar. 12, 2024

(65) Prior Publication Data

US 2024/0315408 A1 Sep. 26, 2024

Related U.S. Application Data

(60) Provisional application No. 63/453,590, filed on Mar. 21, 2023.

(51) Int. Cl.
*A44C 5/10* (2006.01)
*A44C 15/00* (2006.01)

(52) U.S. Cl.
CPC ..... *A44C 15/005* (2013.01)

(58) Field of Classification Search
CPC ..... A44C 15/005; A44C 5/2076; A44C 5/10; A44C 5/102; A44C 5/105; A44C 5/107; A44C 11/007; A44C 5/00; A44C 5/02; A44C 11/00; A44C 13/00
See application file for complete search history.

(56) References Cited

U.S. PATENT DOCUMENTS 214,075 A * 4/1879 Alden ..... A44C 11/00 59/83
1,344,365 A * 6/1920 Wachenheimer ..... A44C 5/102 63/4
1,573,927 A * 2/1926 Fulford ..... A44C 11/007 63/26
1,589,423 A * 6/1926 Payton ..... A44C 11/007 63/26
1,591,815 A * 7/1926 Girdany ..... A44C 5/10 16/221

(Continued)

FOREIGN PATENT DOCUMENTS

FR 2859077 A1 * 3/2005 ..... A44C 11/00
WO WO-2014177149 A1 * 11/2014 ..... A44C 11/00

OTHER PUBLICATIONS

United States Patent and Trademark Office (USPTO), Non-Final Rejection U.S. Appl. No. 18/602,378, dated Jul. 30, 2025, 17 pages (Office Action pp. 1-5; Notice of References Cited pp. 6-9; Search Notes pp. 10-11; Search Strategy and Results pp. 12-17).

*Primary Examiner* — Jason W San
*Assistant Examiner* — Anna S Rashid
(74) *Attorney, Agent, or Firm* — Andrew F. Young, Esq.; NOLTE LACKENBACH SIEGEL

(57) ABSTRACT

A segmented roll resistant necklace system includes a plurality of selected link elements interfitted along a cephalo-caudal (top-to-bottom) length in designated sections to accommodate a relative pivot motion between each adjacent link about a defined link pivot axis and to prevent a relative rotation between adjacent links away from each defined pivot axis in series thereby resisting roll along a length axis of the necklace system.

9 Claims, 27 Drawing Sheets

(56) References Cited

U.S. PATENT DOCUMENTS 1,621,287 A * 3/1927 Speidel ..... A44C 11/007 152/243
1,728,266 A * 9/1929 Fassnacht ..... A44C 11/007 63/26
1,814,792 A * 7/1931 Engel ..... A44C 5/107 63/4
1,831,951 A * 11/1931 Fassnacht ..... A44C 5/107 D11/19
2,143,703 A * 1/1939 Kestenman ..... A44C 5/107 D11/15
2,584,207 A * 2/1952 Holl ..... A44C 11/007 63/4
2,634,593 A * 4/1953 Moretti ..... A44C 11/007 24/616
3,425,214 A * 2/1969 Meng ..... A44C 5/107 59/91
3,436,907 A * 4/1969 Behar ..... A44C 5/105 59/95
3,482,394 A * 12/1969 East ..... A44C 5/107 59/80
5,339,655 A * 8/1994 Grando ..... A44C 5/102 63/26
5,343,718 A * 9/1994 Poll ..... A44C 11/007 63/26
5,592,835 A * 1/1997 Herr ..... A44C 11/007 63/4
5,774,957 A * 7/1998 Kohl ..... A44C 5/2057 24/616
6,418,706 B1 * 7/2002 Kit ..... A44C 5/10 63/4
7,007,508 B1 * 3/2006 Valentini ..... A44C 5/105 63/3
8,156,759 B2 * 4/2012 Nevatia ..... A44C 5/102 63/3
9,010,147 B2 * 4/2015 Barbazza ..... A44C 5/06 63/38
9,622,553 B2 * 4/2017 Lauren ..... A44C 11/00
D873,703 S * 1/2020 Borsari ..... D11/86
10,881,172 B1 * 1/2021 Straus ..... A44C 13/00
11,160,336 B2 * 11/2021 Yurman ..... A44C 5/022
12,310,466 B2 * 5/2025 Koçhisarli ..... A44C 11/007
2002/0184915 A1 * 12/2002 Avakian ..... A44C 5/107 63/9
2002/0194867 A1 * 12/2002 Akyol ..... A44C 15/0025 63/3
2004/0103689 A1 * 6/2004 Chia ..... A44C 11/007 63/26
2005/0210918 A1 * 9/2005 Fufuangvanich .... A44C 11/007 63/28
2007/0044511 A1 * 3/2007 Marco ..... A44C 5/022 63/38
2009/0151393 A1 * 6/2009 Spigner ..... A44C 9/003 63/3.1
2010/0024483 A1 * 2/2010 Nevatia ..... A44C 5/102 29/11
2010/0192630 A1 * 8/2010 Sorenson ..... A44C 5/105 63/3
2014/0000313 A1 * 1/2014 Barbazza ..... A44C 13/00 63/4
2016/0192745 A1 * 7/2016 Lauren ..... A44C 5/105 59/89
2016/0316864 A1 * 11/2016 Cluseau ..... A44C 27/00
2017/0311685 A1 * 11/2017 Yamakawa ..... A44C 5/107
2020/0004043 A1 * 1/2020 Head ..... G02C 3/006
2021/0015219 A1 * 1/2021 Bonfante ..... A44C 11/007
2021/0244139 A1 * 8/2021 Yurman ..... A44C 25/007
2024/0008599 A1 * 1/2024 Cluzeau ..... A44C 5/02
2025/0031812 A1 * 1/2025 Koçhisarli ..... A44C 11/007

* cited by examiner

SEGMENTED ROLL RESISTANT NECKLACE SYSTEM

CROSS REFERENCE TO RELATED APPLICATIONS

This application is related to U.S. Prov. Ser. No. 63/453,590 filed Mar. 21, 2023, the entire contents of which are incorporated herein by reference.

BACKGROUND OF THE INVENTION

Field of the Invention

The present invention generally relates to a segmented roll resistant necklace system. More particularly, this invention relates to a segmented roll resistant necklace with a plurality of link elements interfitted to control and accommodate a relative pivot motion between each respective adjacent link about a necklace pivot axis and to resist a relative rotation between each adjacent link away from the necklace pivot axis in series in the system thereby resisting roll along a cephalocaudal (top-to-bottom) length of the segmented necklace system.

Description of the Related Art

Conventional necklace systems with a plurality of segmented interconnected links allow relative rotation both laterally and radially relative to the next adjacent link. As a result, conventional segmented necklace systems allow continuous rotation and motion in three dimensions (X, Y, and Z) of one link relative to the next-link in line. As a result, when a conventional segmented necklace is worn and draped on a user with a dynamic profile (neck, collar bones, chest) the individual links of the conventional necklace rotate relative to each other and often fully invert (turn upside down) on a user or potentially fully rotate along a long axis providing an unattractive visual appearance. Such difficulties in the hanging and easy rolling of conventional necklaces allow intermittent display of stones or decorative indicia on a top-side (between roll-pivots) and also detrimental intertwining entanglement with fabric, hair, or other jewelry items, risking damage and being difficult to untangle.

Referring now to FIGS. 1, 2, and 3, a conventional segmented necklace 1000 is illustrated in a conventional hanging arc curve (FIG. 1) and noted under the influence of gravitational (weight) hanging around a neck (FIG. 2). A dynamic conventional illustration (FIG. 3) notes the three general sections for a hanging necklace. As noted, there is a curve section (around a user's neck), which transitions to a bend section (from about a collar-bone region to a hanging region), and a final hang and curve section there below (wherein the necklace joins and follows in a curve along a user's chest region from side to side forming a continuous loop).

As illustrated in FIG. 3, the stresses on a conventional segmented necklace 1000, with continuous common links along an entire length, undergoes a pulling (in the curve section) relative to a user, a roll and a rotation force (as the necklace falls along the collar bone (in a bend section), and a further twist inducement (see image) on either side of the bend section (in the hang and curve section) as the conventional segmented necklace attempts to accommodate the roll and bend and curve motions and rotates along the long necklace axis one or more times. As a result, those of skill in the art readily appreciate that conventional bending motion and rotation forces developed in the collar bone/bend section (and related transitions through curve section and hanging sections) result in partial or full rotation (or multiple segment multi-rotations) along the cephalocaudal (top-to-bottom) length of a conventional necklace. As noted below, the phrase cephalocaudal is used descriptively for an elongated, multi-segmented, joined-together-segment system from one end to another (either elongated or joined together in a loop from a top to a bottom).

The present invention attempts to address at least one, and preferably more than one, of the concerns noted herein above.

ASPECTS AND SUMMARY OF THE INVENTION

The present invention address at least one of the concerns noted above.

According to one alternative aspect of the present invention, there is provided a segmented roll resistant necklace system that includes a plurality of selected link elements interfitted along a cephalocaudal (top-to-bottom) length in designated sections to accommodate a relative pivot motion between each adjacent link about defined link pivot axes and to prevent a relative rotation between adjacent links away from each defined pivot axis in series thereby resisting roll along the length axis of the necklace system.

According to another alternative aspect of the present invention, there is provided a segmented roll resistant necklace assembly, as shown and described.

According to another alternative aspect of the present invention, there is provided a segmented roll resistant necklace assembly, comprising: a clasp arrangement having a first clasp end and a second clasp end, a plurality of pull links secured to each of the clasp end and extending away from the clasp arrangement to a respective transition assembly, each transition assembly, further comprising: a converter link connected to an end of the plurality of pull links, a dual link connected to the converter link, and a plurality of ring links connecting each respective the dual link on each of the transition assembly thereby forming the necklace assembly.

According to another alternative aspect of the present invention, there is provided a segmented roll resistant necklace assembly comprising: a clasp arrangement having a first clasp end and a second clasp end, a center ring link having a first side and a second side, a plurality of center side ring links secured to each of the first side and the second side of the center ring link and extending away from the center ring link to a respective first transition assembly, each first transition assembly, further comprising: a first converter link connected to a last one of the center side ring links and a respective pin link of a plurality of pin links on each respective first and the second side, the plurality of pull links secured to each of the clasp end and extending away from the clasp arrangement to a respective second transition assembly, each second transition assembly, further comprising: a second converter link connected to an end of the plurality of pull links, and a last one of the plurality of pin links connected to the second converter link.

According to another alternative aspect of the present invention, there is provided a segmented roll resistant necklace assembly further comprising: a pull link clasp segment on each of the first clasp end and the second clasp end, and the plurality of pull links extending from respectively the first clasp end and the second clasp end.

According to another alternative aspect of the present invention, there is provided a segmented roll resistant necklace assembly, wherein: each of the pull links, further comprises: a brace hole on a first pull link contact side, and a cantilever bar arm on a second pull link contact side.

According to another alternative aspect of the present invention, there is provided a segmented roll resistant necklace assembly wherein: each of the first converter links, further comprises: a cantilever slot brace stub on a first contact side of the converter link, and a convex link contact pivot side surface on a second side surface of the first converter link.

According to another alternative aspect of the present invention, there is provided a segmented roll resistant necklace assembly wherein: each of the second converter links, further comprises: a cantilever bar arm on first contact side of the second converter link, and a concave link contact pivot side surface on a second side surface of the second converter link.

According to another alternative aspect of the present invention, there is provided a segmented roll resistant necklace assembly wherein: each of the pin links, further comprises: a convex link contact pivot side surface on a first contact side of the pin link, and a convex link contact pivot side surface on a second contact side of the pin link.

According to another alternative aspect of the present invention, there is provided a segmented roll resistant necklace assembly wherein: each of the ring links, further comprises: a cantilever slot brace stub on a first ring link contact side, and a cantilever bar arm on a second ring link contact side.

According to another alternative aspect of the present invention, there is provided a segmented roll resistant necklace assembly wherein: the center ring link, further comprises: a first cantilever slot arm extending from a first contact side of the center ring link, and a second cantilever slot arm extending from a second contact side of the center ring link.

The above and other aspects, features and advantages of the present invention will become apparent from the following description read in conjunction with the accompanying drawings, in which like reference numerals designate the same elements.

BRIEF DESCRIPTION OF THE DRAWINGS

FIG. 5A is a top front perspective view of the clasp assembly in a closed position noting engagement. FIG. 5B is a front side elevation view. FIG. 5C is a top view. FIG. 5D is a sectional view along section line 5D-5D in FIG. 5C. FIGS. 5E and 5F are perspective extended views of the clasp assembly in an unengaged position.

FIG. 6A is a front top perspective view of a center ring link. FIG. 6B is a rear top perspective view of a center ring link showing the cantilever brace side slot as will be discussed. FIG. 6C is a bottom rear perspective view of FIG. 6B noting the cantilever brace side slot receiving each cantilever slot arm in a bent condition (extended positions shown in dashed lines throughout) a center ring link. FIG. 6D is a top plan view of a center ring link with each cantilever slot arm in a bent closed position. FIG. 6E is a front elevation view of a center ring link.

FIG. 7A is a front top perspective view. FIG. 7B is a rear top perspective view. FIG. 7C is a bottom front perspective view. FIG. 7D is a top plan view. FIG. 7E is a front elevation view. FIG. 7F is a left side elevation view. FIG. 7G is a rear elevation view (mirror of FIG. 7E). FIG. 7H is a right side elevation view (other side of FIG. 7F).

FIG. 8A is a front top perspective view. FIG. 8B is a top plan view noting the closing bending motion of a cantilever slot arm during an assembly. FIG. 8C is a front elevation view noting position relative to a necklace long pivot axis.

FIG. 9A is a left front top perspective view of the pin link right. FIG. 9B is a top right perspective view shown in combination with a pivot pin used for assembly. FIG. 9C is a further bottom rear perspective view from the rear of FIG. 9B noting assembly with two pivot pins (as shown). FIG. 9D is a top plan view. FIG. 9E is a front elevation view noting location along the necklace long pivot axis. FIG. 9F is a left side elevation view in combination with a pivot pin assembly insert location. The FIGS. 9B, 9C, and 9F are shown with one (or more pivot pins) related for insertion upon joining links as will be understood in operation.

FIG. 10A is a left front top perspective view. FIG. 10B is a right top perspective view in combination with a pivot pin. FIG. 10C is a bottom rear perspective view noting in combination with two pivot pins through pivot points, as will be discussed. FIG. 10D is a top plan view. FIG. 10E is a front elevation view noting relation of pivot centers along necklace long pivot axis. FIG. 10F is a right side elevation view in relation to a pivot pin. FIGS. 10B, 10C, and 10F are shown with one (or more) pivot pins related for insertion upon joining links during an assembly of a necklace.

converter link used to join a center ring link and respectively a pin link. It will be recognized that an exemplary left side first converter link (not shown) is a mirror image of the shown right side first converter link. FIG. 11A is a front top perspective view. FIG. 11B is front top perspective view shown with a joining pin. FIG. 11C is a rear top perspective view (a rotation of FIG. 11B). FIG. 11D is a top plan view. FIG. 11E is a front elevation view of FIG. 11A. FIG. 11F is a left side elevation view. FIGS. 11B, 11C, and 11F are shown with an exemplary pin for assembly.

FIG. 12A is a front top perspective view. FIG. 12B is a bottom front perspective view. FIG. 12C is a further top front perspective view. FIG. 12D is a top plan view. FIG. 12E is a front elevation view. FIG. 12F is a rear bottom perspective view. The pivot openings are shown where pivot pins would be inserted to join the segments in the roll resistant segmented necklace for the proposed invention.

FIG. 13A is a top front perspective view. FIG. 13B is a bottom front perspective view. FIG. C is a rear top perspective view. FIG. 13D is a top perspective view. FIG. 13E is a front elevation view. FIG. 13F is a rear bottom perspective view.

FIG. 14A is a top front perspective view. FIG. 14B is a bottom rear perspective view. FIG. 14C is a further top front perspective view. FIG. 14D is a top plan view. FIG. 14E is a front elevation view. FIG. 14F is a bottom rear perspective view.

FIG. 15A is a front perspective view. FIG. 15B is a top plan view. FIG. 15C is a bottom plan view. FIG. 15D is a front elevation view. FIG. 15E is a section of Fig. FIG. 15B along section 15E-15E. FIG. 15A illustrates the position of pivot pin insertions between the pin links and converter links. It will be understood that a mirror image thereof is also present to complete the necklace so that a left side transition assembly is a mirror image of a right side transition assembly.

FIG. 16A is a front perspective view. FIG. 16B is a top plan view. FIG. 16C is a bottom plan view. FIG. 16D is a front elevation view. FIG. 16E is a sectional view of FIG. 16B along section 16E-16E. FIG. 16F illustrates a partially exploded view of an assembly of a center ring link (left or right) joining with a first converter link. It will be understood that a mirror image thereof is also present to complete the necklace.

FIG. 17A is a front perspective view. FIG. 17B is a top plan view. FIG. 17C is a bottom plan view. FIG. 17D is a front elevation view. FIG. 17E is a sectional view of FIG. 17B along section 17E-17E. FIG. 17F illustrates a partially exploded view of the assembly of a center ring link with respective left-center ring link and right-center ring link.

DETAILED DESCRIPTION OF THE PREFERRED EMBODIMENTS

Figure 1:
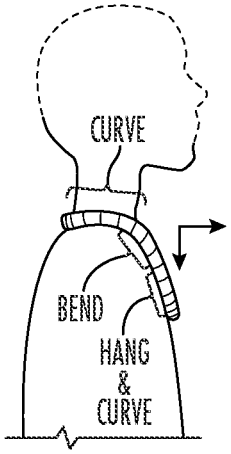
FIG. 1 PRIOR ART
FIGS. 1, 2, and 3 represent illustrative graphics of a conventional segmented necklace within an illustrated construct of a user noting the curve, bending and rolling influence upon links in a segmented conventional necklace while worn on a user.
Figure 2:
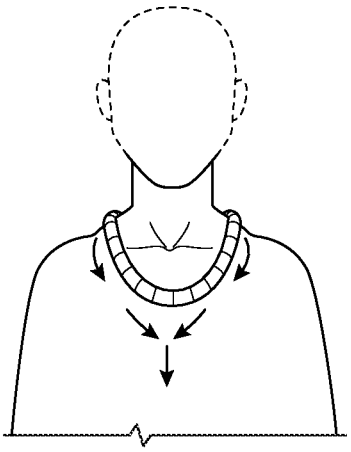
FIG. 2 PRIOR ART
Figure 3:
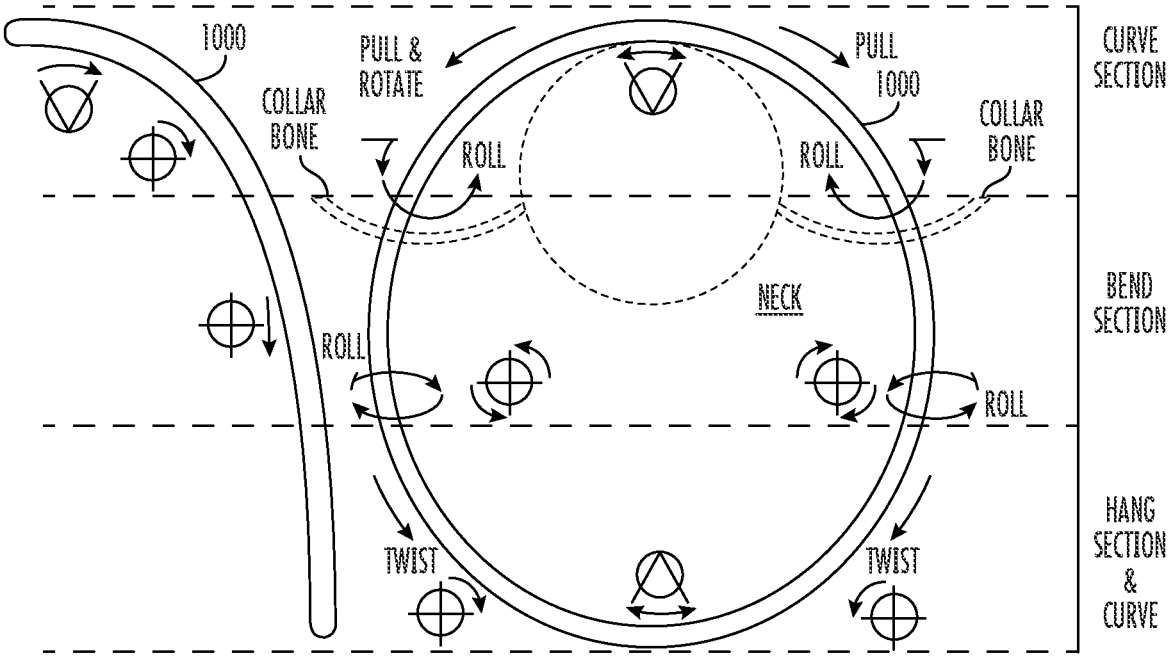
FIG. 3 PRIOR ART
Figure 4:
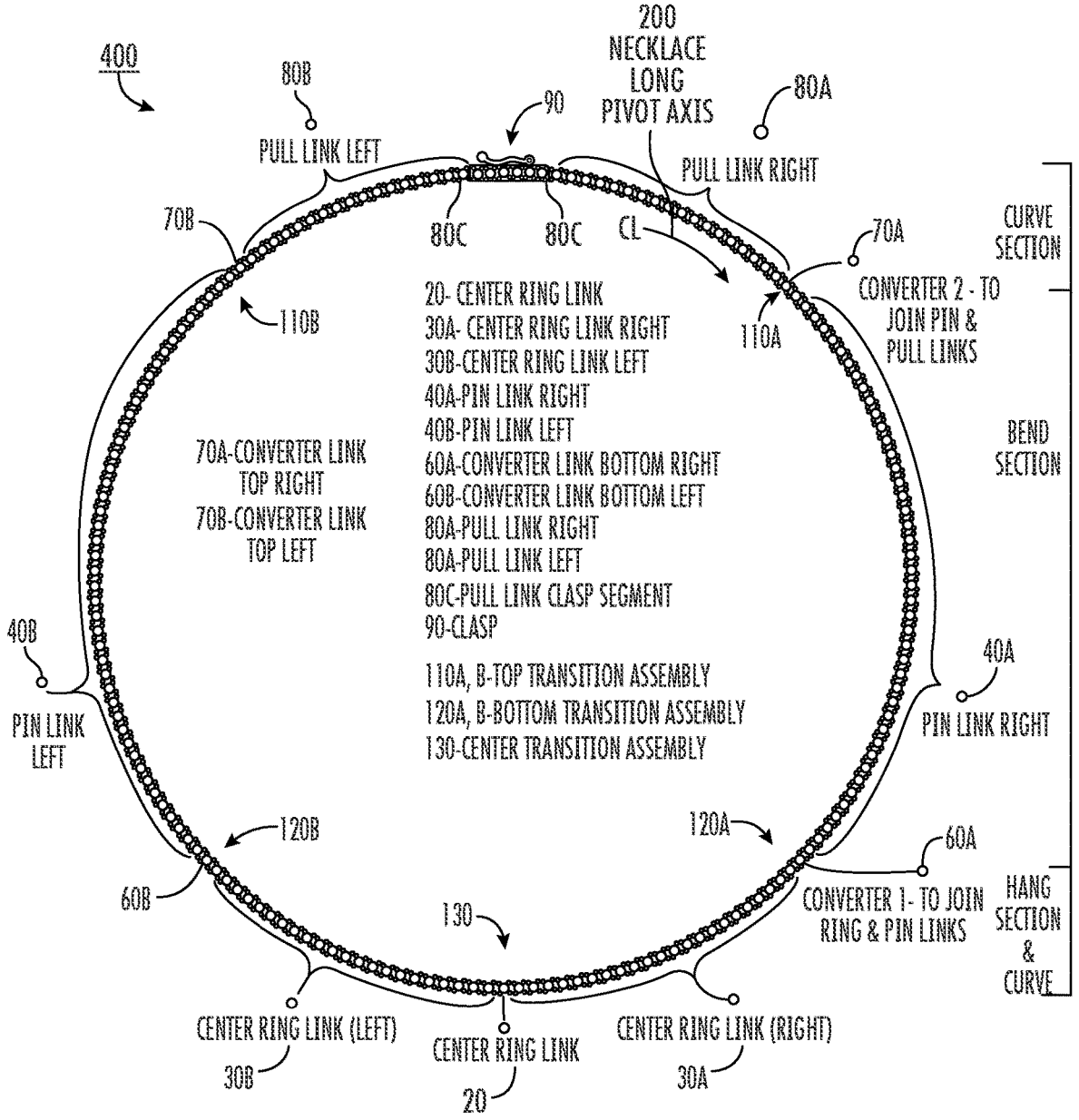
FIG. 4 is an illustrative view of an exemplary segmented roll resistant necklace noting sectional portions thereof.
Figure 5A:
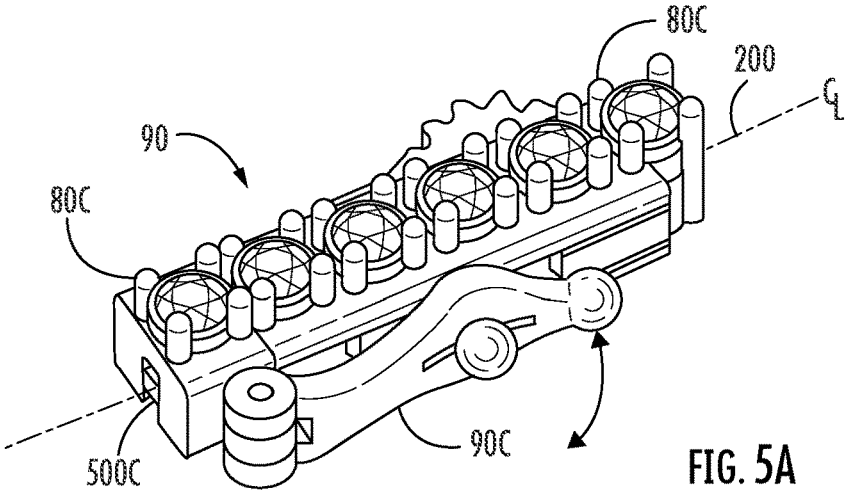
FIGS. 5A through 5F provide illustrative views of an exemplary clasp arrangement segment for the proposed invention.
Figure 5B:
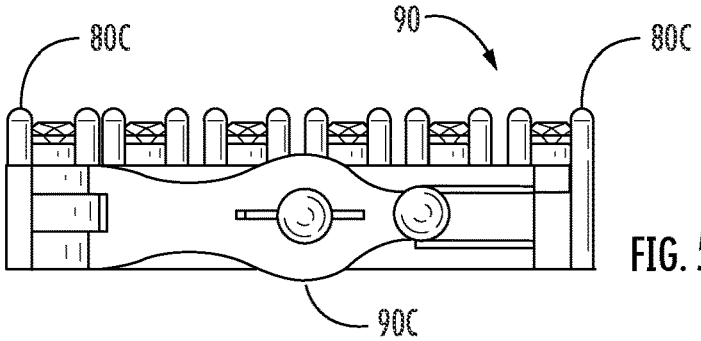
Figure 5C:
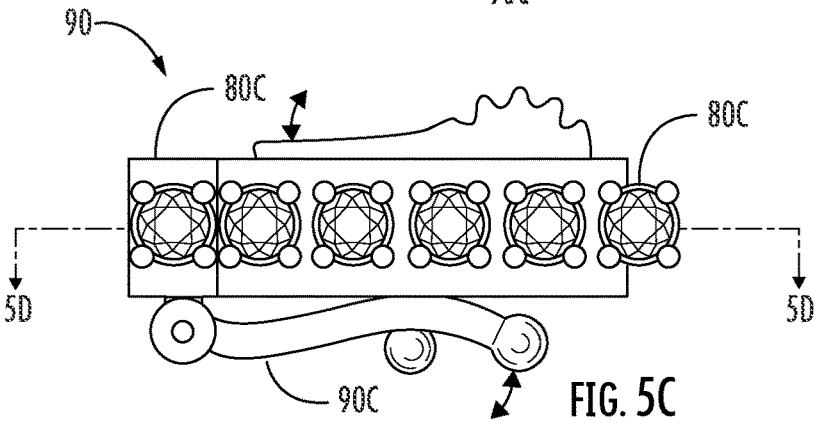
Figure 5D:
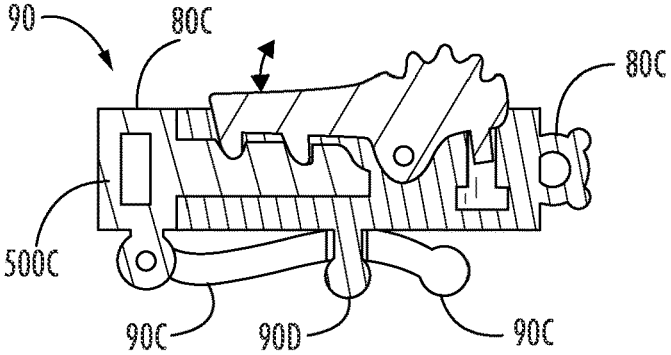
Figure 5E:
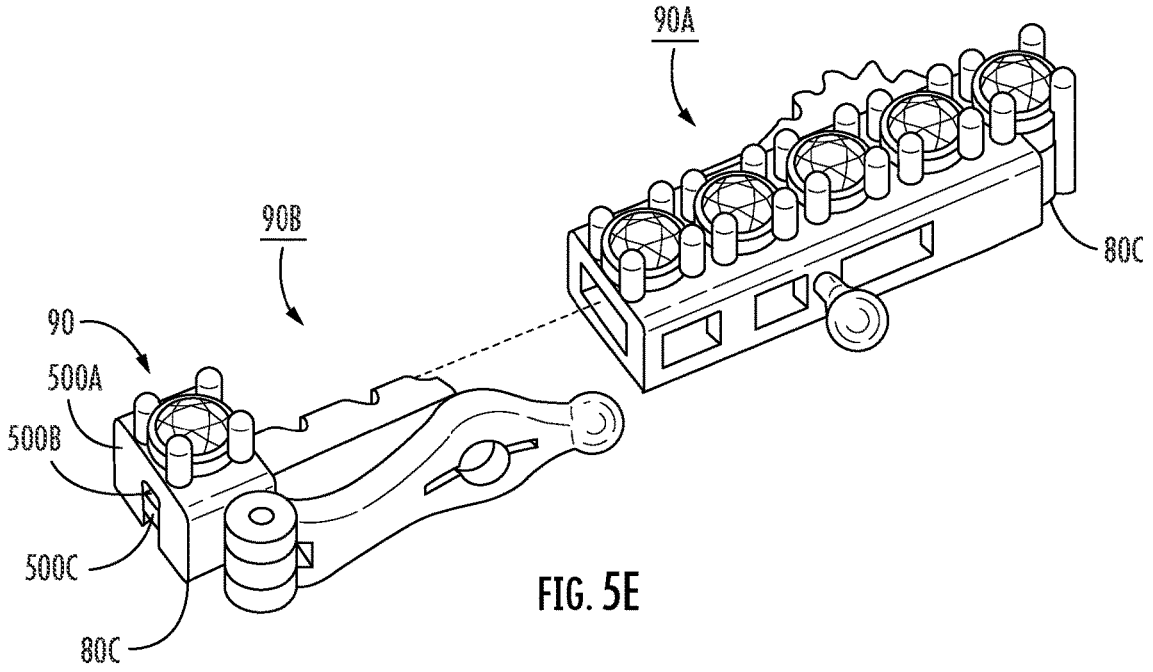
Figure 5F:
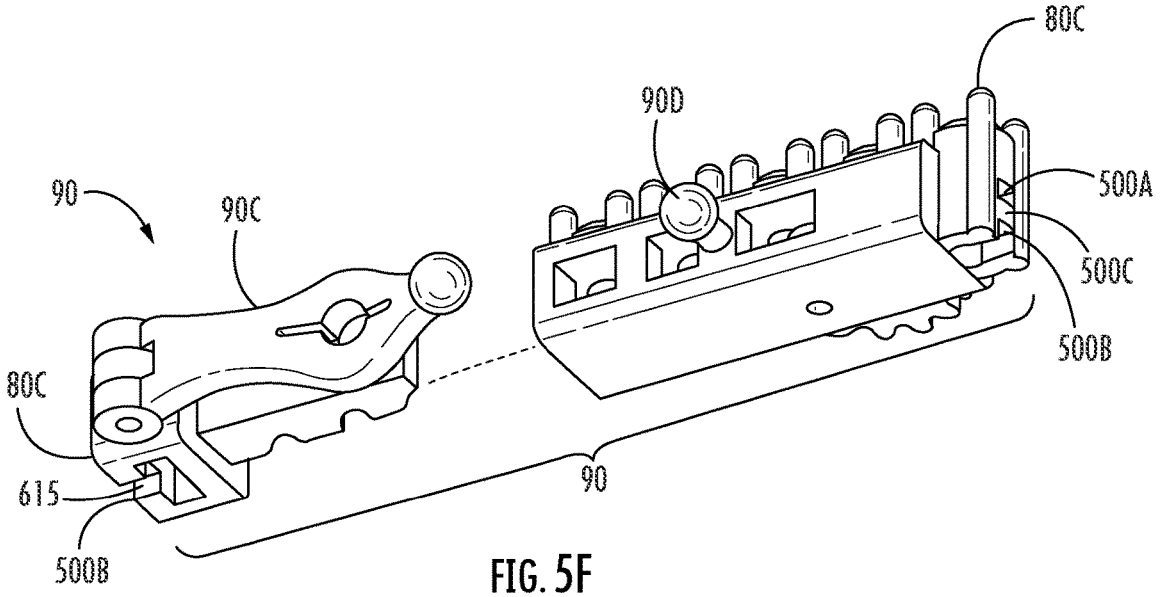
Figure 6A:
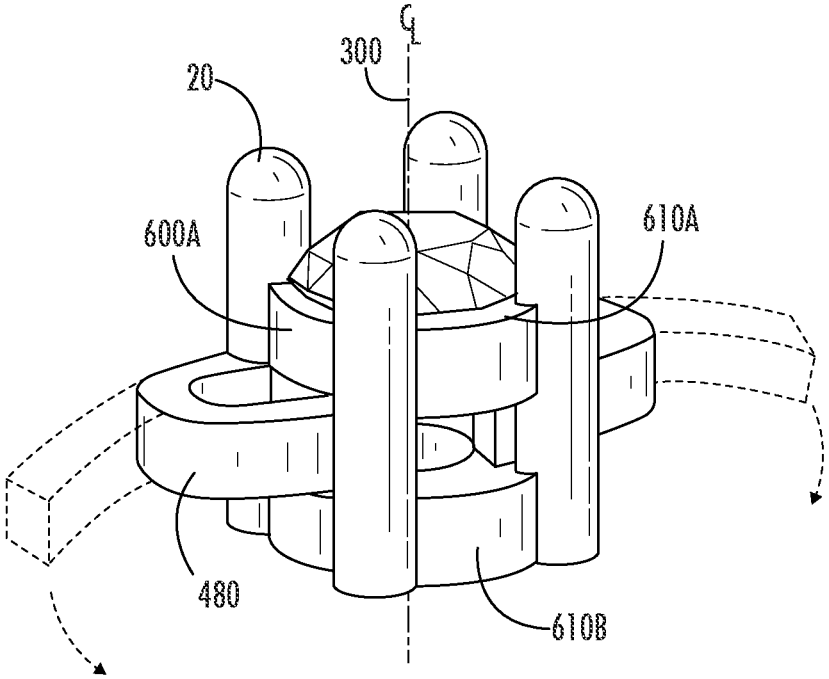
FIGS. 6A to 6E illustrate an exemplary center ring link (a dual ring link) segment used in an exemplary segmented roll resistant necklace for the proposed invention.
Figure 6B:
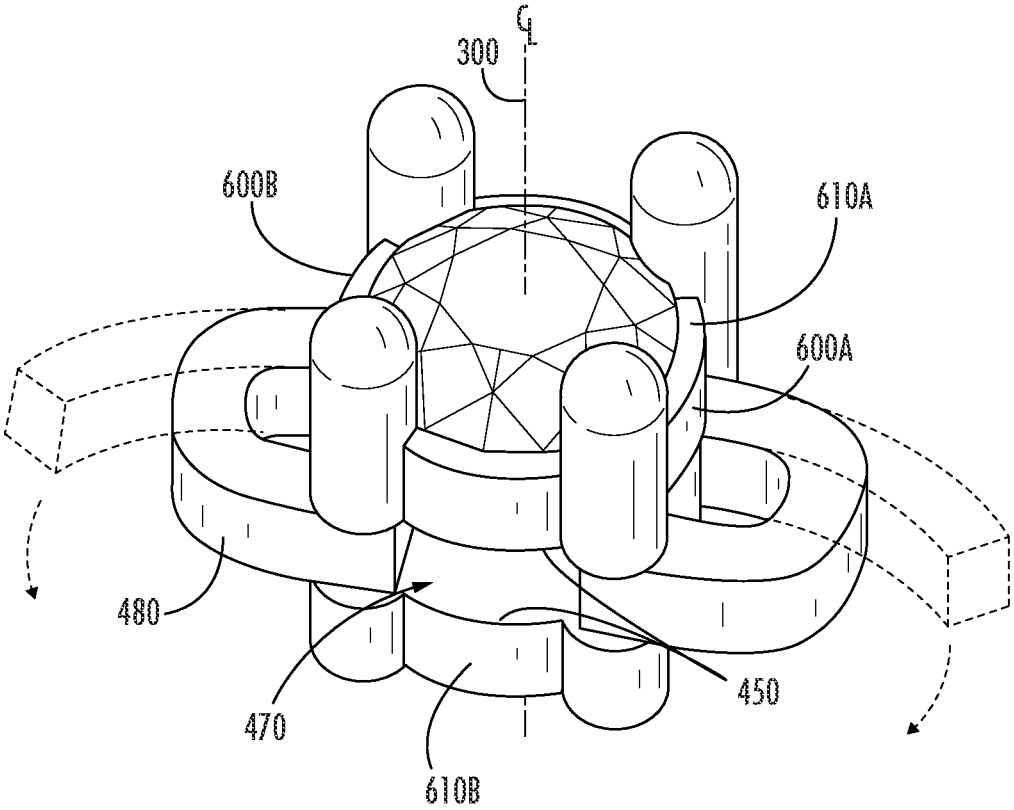
Figure 6C:
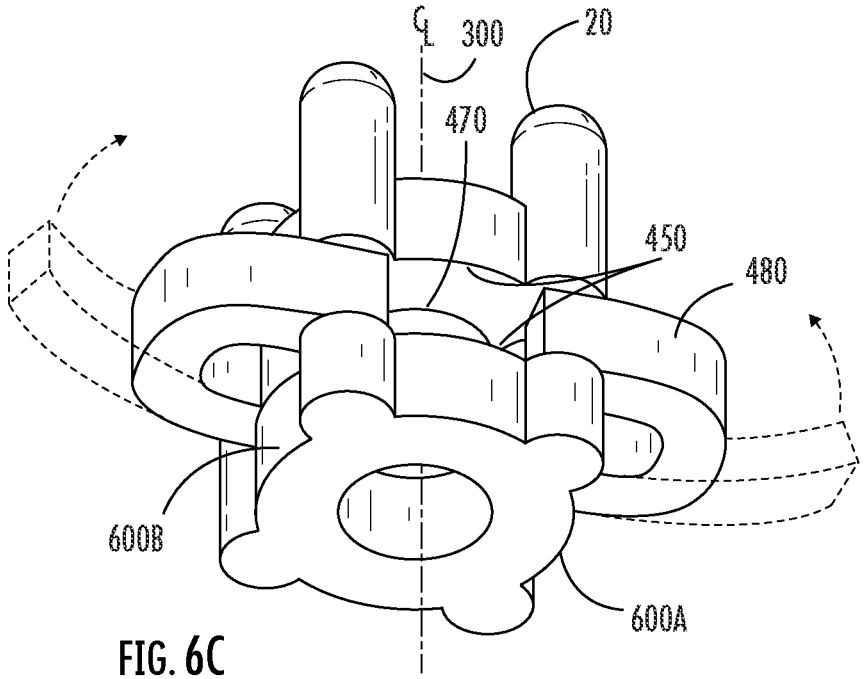
Figure 6D:
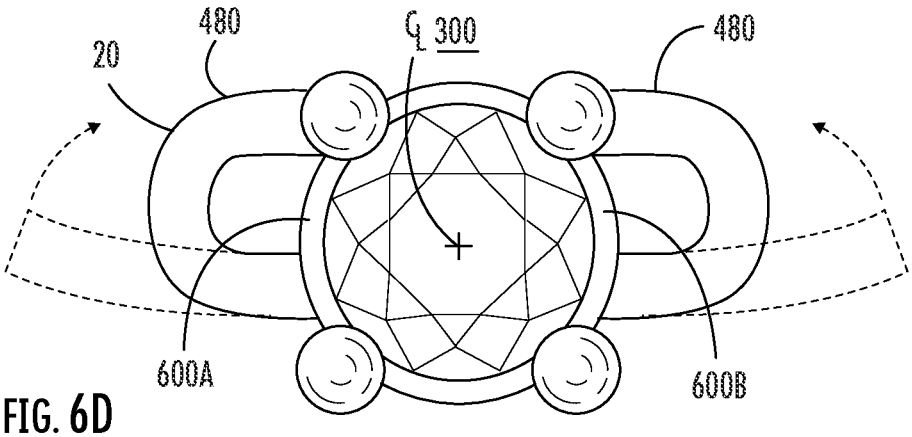
Figure 6E:
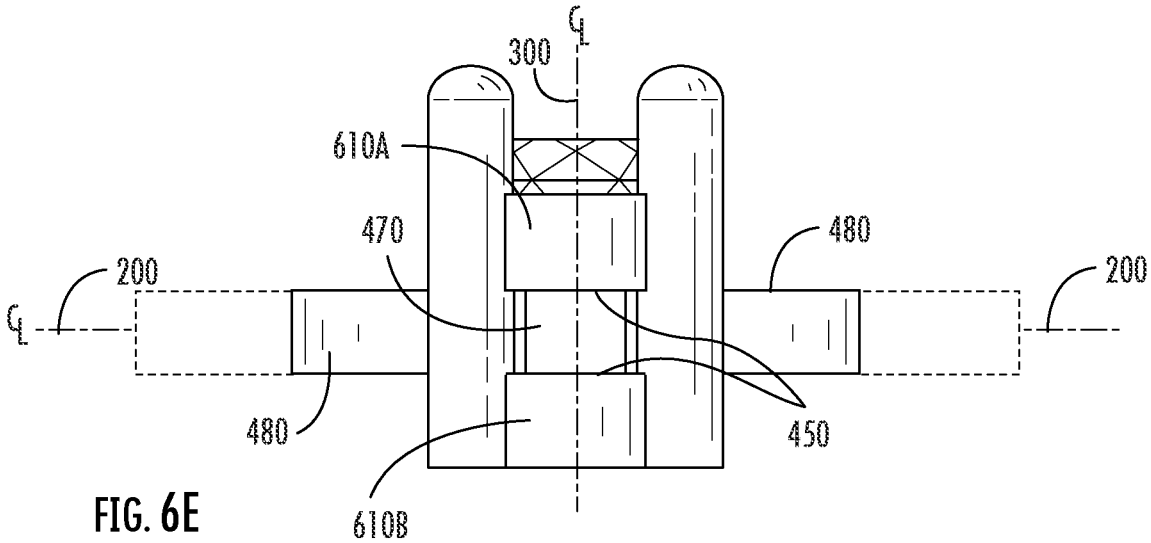

Reference will now be made in detail to embodiments of the invention. Wherever possible, same or similar reference numerals are used in the drawings and the description to refer to the same or like parts or steps. The drawings are in simplified form and are not to precise scale. The words 'couple' or 'join' or 'secure' and similar terms do not necessarily denote direct and immediate connections, but also include connections through intermediate elements or devices. For purposes of convenience and clarity only, directional (up/down, etc.) or position (top/bottom/side) or motional (forward/back, etc.) terms may be used with respect to the drawings. These and similar directional terms should not be construed to limit the scope in any manner. It will also be understood that other embodiments may be utilized without departing from the scope of the present invention, and that the detailed description is not to be taken in a limiting sense, and that elements may be differently positioned, or otherwise noted as in the appended claims without requirements of the written description being required thereto.

Referring now to FIGS. 4 through 10E a segmented roll resistant necklace 400 having a necklace long pivot axis 200 and a plurality of segment elements (as discussed in detail herein below) is shown (FIG. 4) defining an upper curve section, a bend section, and a hang and curve section, as will be discussed.

Segmented roll resistant necklace 400 contains a clasp arrangement segment 90 affixed to mirror image pull link clasp segments 80C, 80C, which extend outwardly in series (as shown) through a plurality of individual pull links 80A, 80B (left or right), respective top converter links 70A, 70B (left or right) to respective pin links 40A, 40B (left or right) to respective bottom converter links 60A, 60B (left or right) to respective center side ring links 30A, 30B (or alternatively center ring links 30A, 30B) (left or right) to a final center ring link 20 (as shown). A respective left and right top transition assembly 110A, 110B (See FIG. 4, and FIGS. 15A through 15E) is shown referring to the transition proximate the curve-section-to-bend section on each side of necklace 400 from a left or right pull link 80A, 80B through respective left or right top converter links 70A, 70B to respective left or right pin links 40A, 40B with respective pins (shown elsewhere). A respective left and right bottom transition assembly 120A, 120B (See FIG. 4, and FIGS. 15A through 16F) is shown referring to the transition proximate the bend-section-to-hang-and-curve section on each side of necklace 400 from a left or right pin link 40A, 40B through respective left or right bottom converter links 60A, 60B to respective left or right center ring links 30A, 30B, with respective pins (shown elsewhere). It will be understood that ring links 30A, 30B are understood as being on a side of center ring link 20 (See FIG. 4) and as a result may be adaptively referred to as side ring links 30A, 30B or center ring links 30A, 30B without departing from the scope and spirit of the present invention.

Clasp arrangement 90 includes a female portion 90A and a male portion 90B including a pivot lock bar 90C enjoining a lock protuberance 90D. On either side of clasp arrangement 90 and affixed thereto are pull link clasp segment portions 80C, 80C, joined with respectively female portion 90A and male portion 90B, as shown (as will be shown in the individual pull links 80 (see FIGS. 9A-9H). As a result, each pull link clasp segment 80C, 80C includes a brace hole 500A, a partial brace bottom slot 500B (a full brace bottom slot 500B with full brace bottom slot contact surfaces 615 (as additionally noted in FIGS. 5E, 5F, 13B, 13C, 14B, 14C), and crossing is formed a brace bar 500C that spans either side of partial brace bottom slot 500B forming brace hole 500A, with respective bar hole contact surfaces 510, as will be appreciated.

Transition link assemblies 110A, 110B, and 120A, 120B are positioned along segmented roll resistant necklace 400 aligned with necklace pivot axis (long axis) 200 proximate a top-side one-quarter to one-half of the side-arc of the necklace 400 (See FIG. 4) (for the top transition assemblies 110A, 110B) to approximately a bottom-side one-quarter to one-half of the side arcs of necklace 400 (See FIG. 4) so as to approximate a user's support profile without rotation about the long pivot axis 200. As a result of the assembly system herein, and the use of top and bottom transition link assemblies 110A, 110B, 120A, 120B rotation along necklace long pivot axis 200 between respective links and along the entire length is effectively minimized and eliminated as will be discussed. Transition link assemblies 110A, 110B are effective to transition from respective pull links 80A, 80B to respective pin links 40A, 40B to resist and accommodate any rolling urge built up along the length of pull links 80A, 80B from clap arrangement 90 thereby preventing any respective relative rotation along neck axis 200 (eliminating roll) while allowing suitable bend displacement between the respective links, each having a relative link short pivot axis 300 (see FIG. 10A and others), so as to allow segmented necklace 400 to transition from a curve section through a bend section to a hang and curve section without curvature.

Figure 11A:
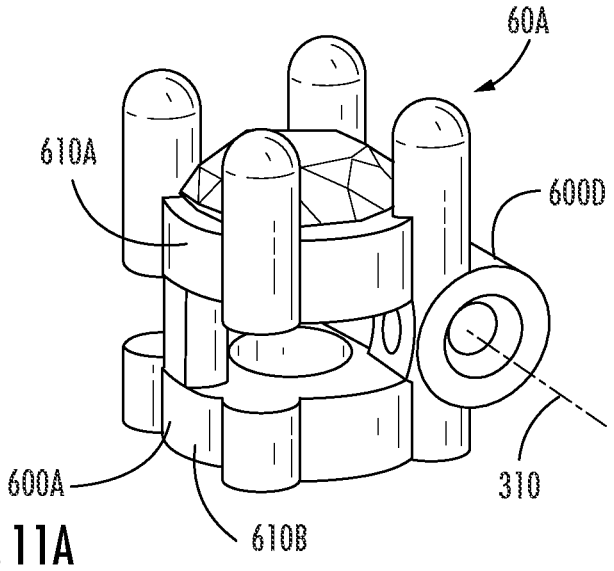
FIGS. 11A to 11F illustrate an exemplary side first (bottom right side and mirror image left side (See FIG. 4))
Figure 11B:
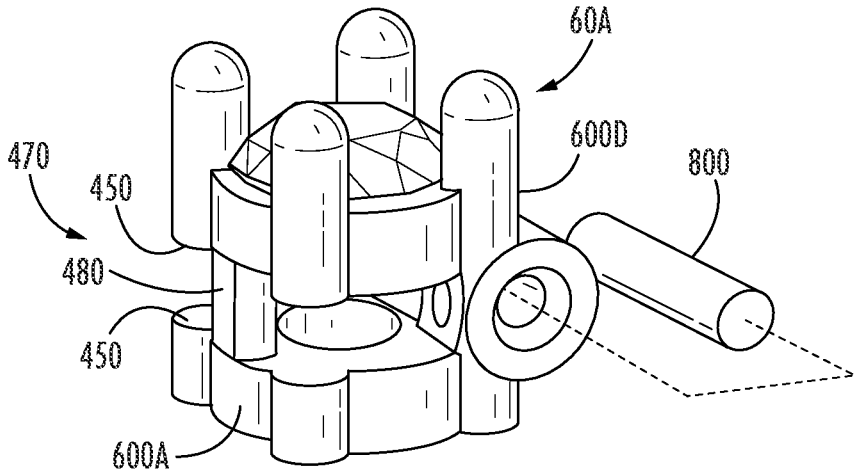
Figure 11C:
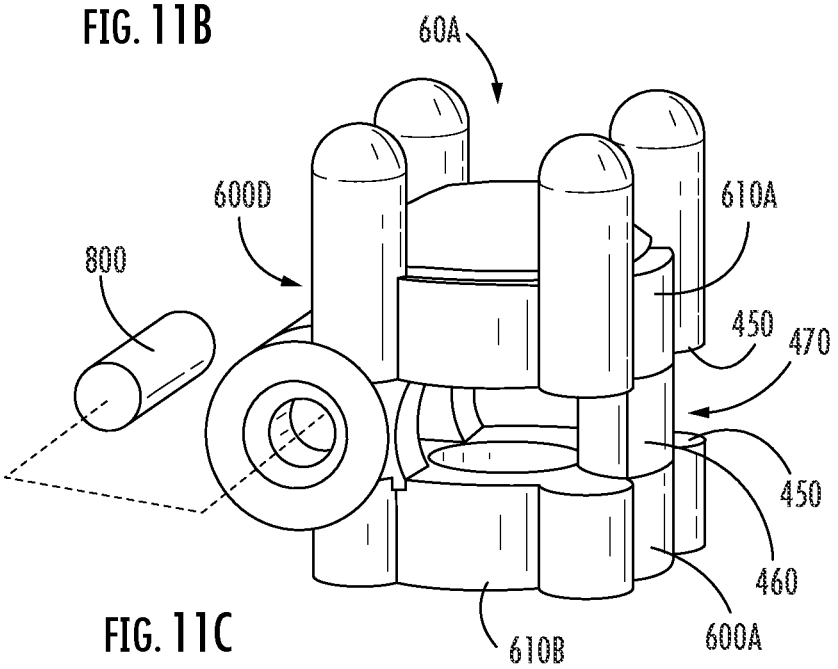
Figure 11D:
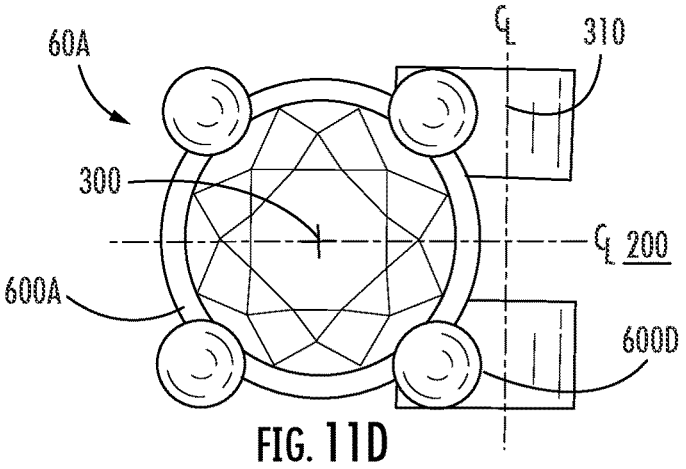
Figure 11E:
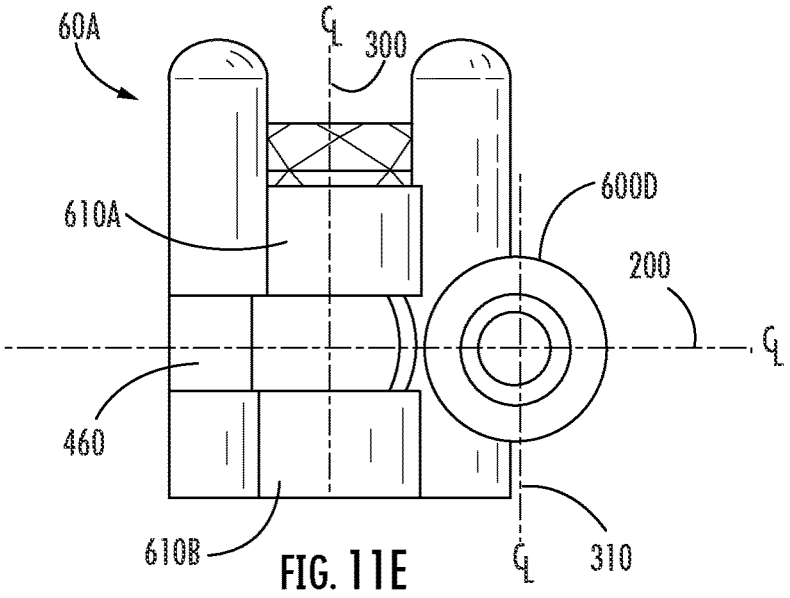
Figure 11F:
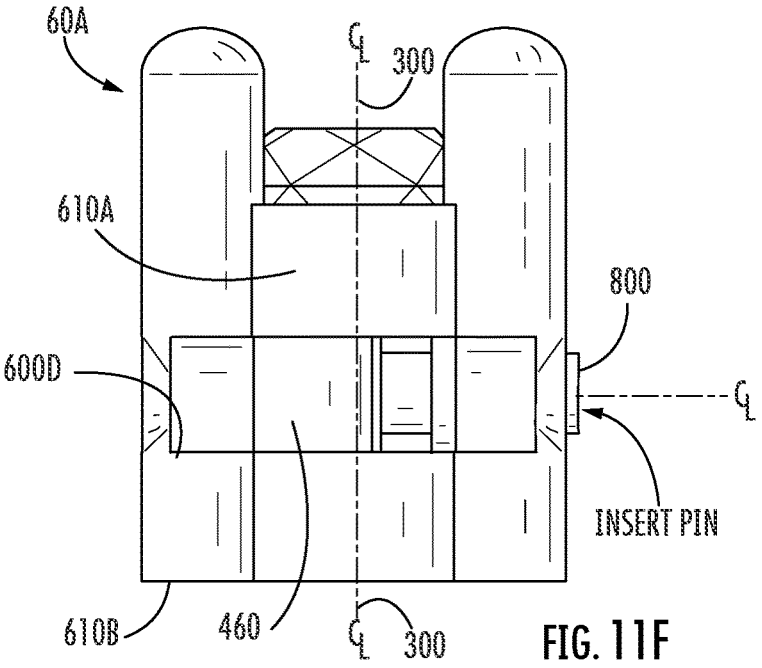
Figure 12A:
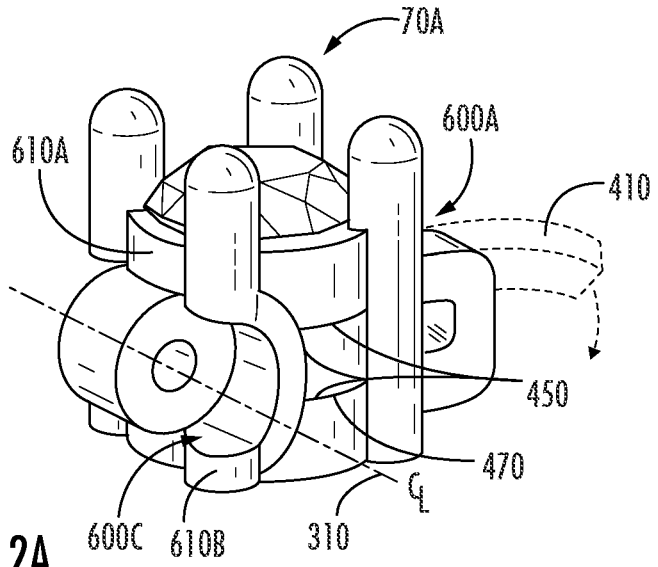
FIGS. 12A to 12F illustrate an exemplary side second (top right side 70A, left side 70B (See FIG. 4)) converter link used to join a pin link and a pull link. It will be recognized that the left side second converter link (not shown) is a mirror image of the shown right side second converter link.
Figure 12B:
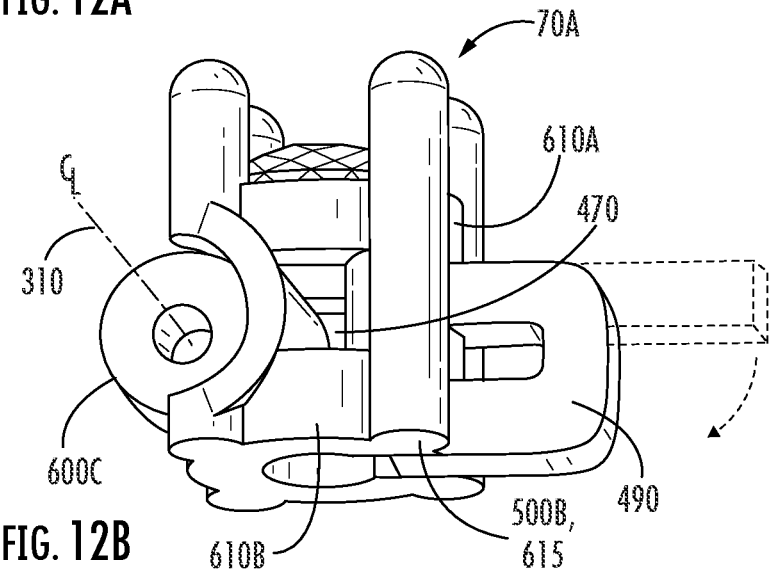
Figure 12C:
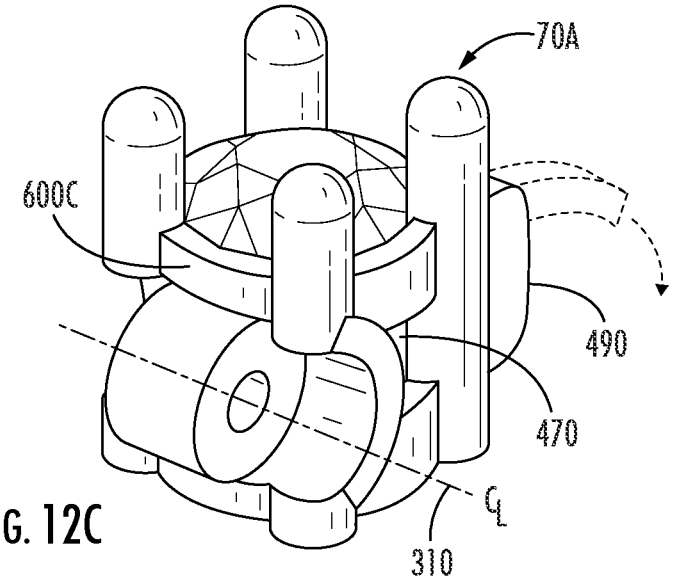
Figure 12D:
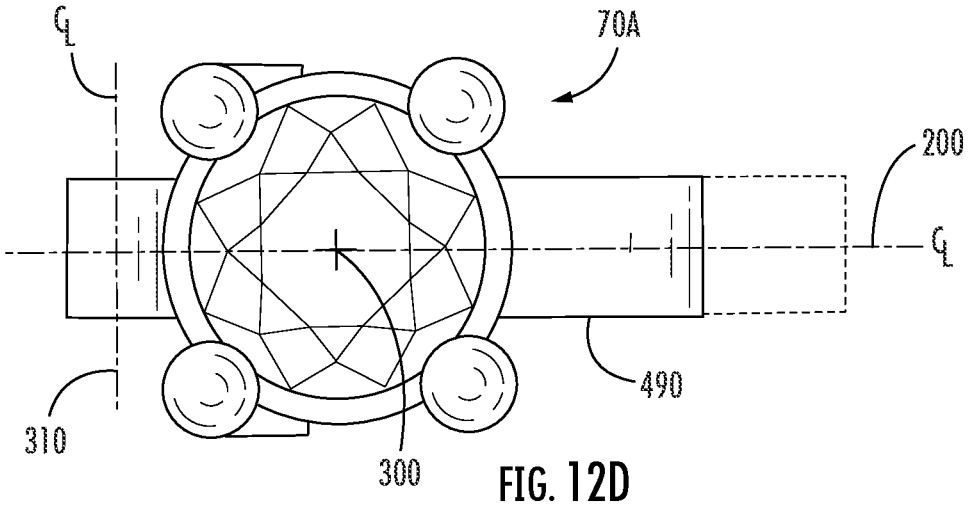
Figure 12E:
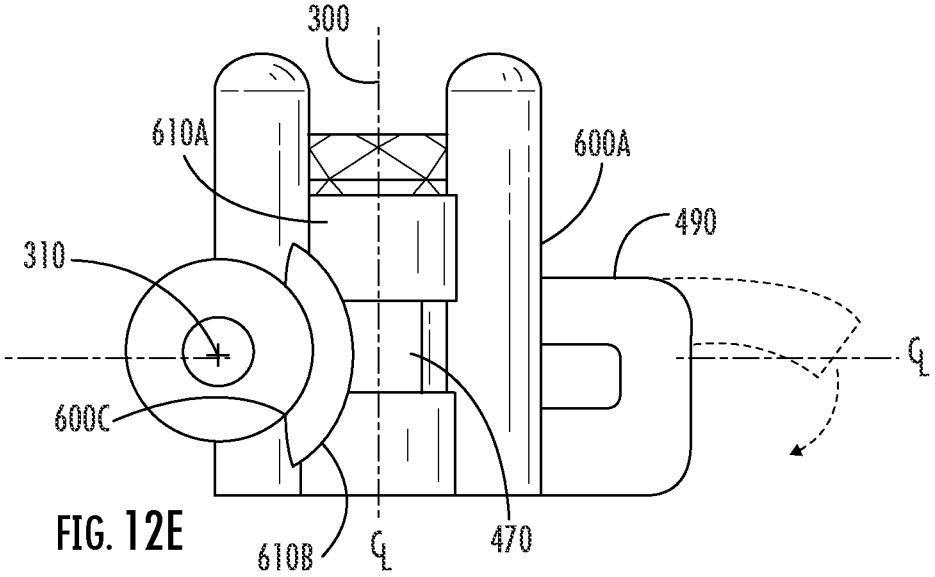
Figure 12F:
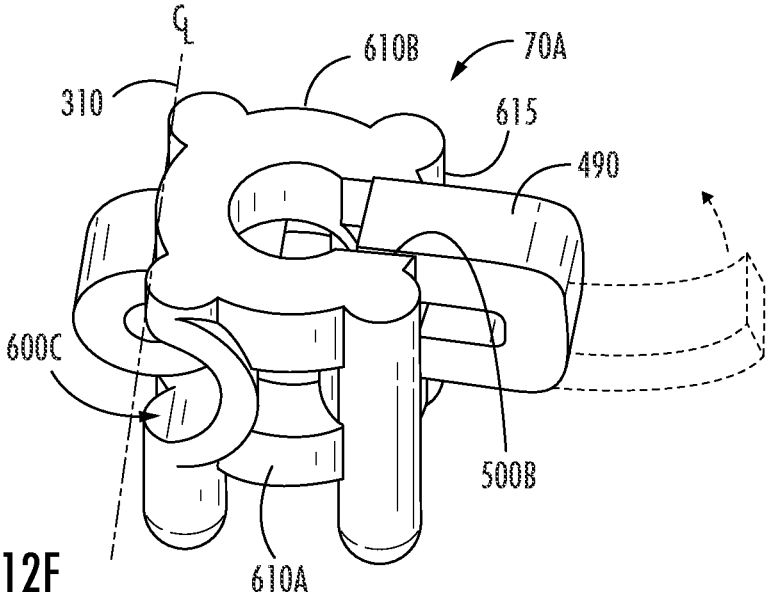
Figure 13A:
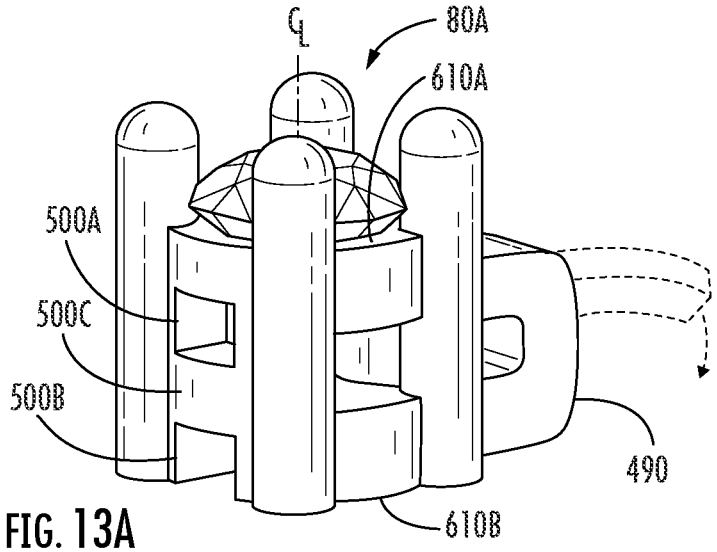
FIGS. 13A to 13F illustrate exemplary pull links right side joining a second converter link (right side) to the clasp arrangement (See FIG. 5A).
Figure 13B:
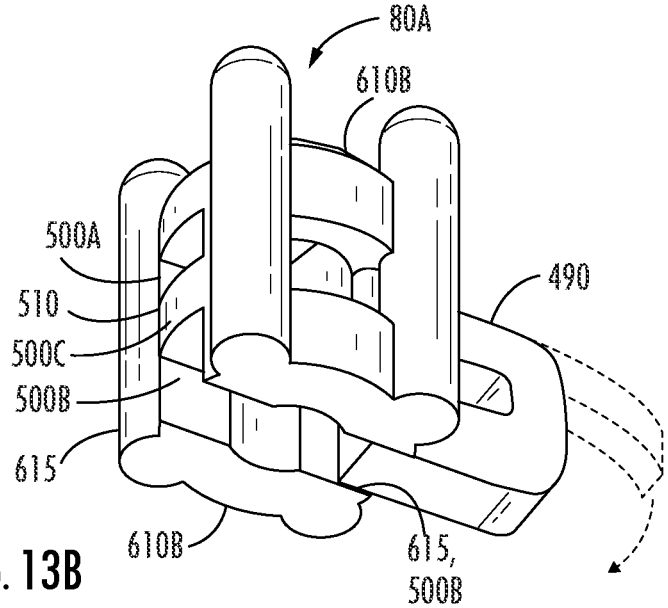
Figure 13C:
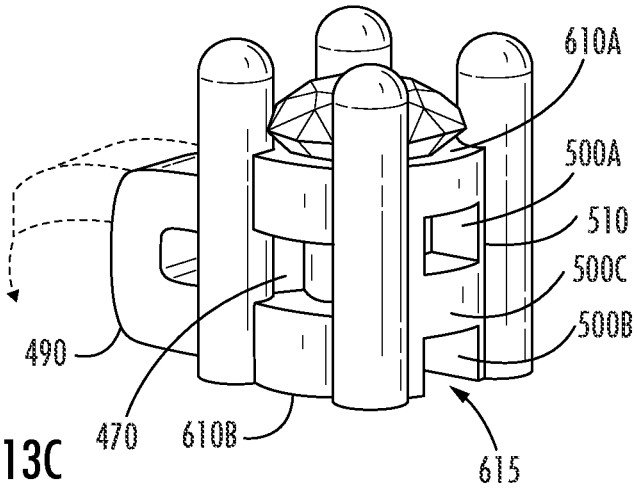
Figure 13D:
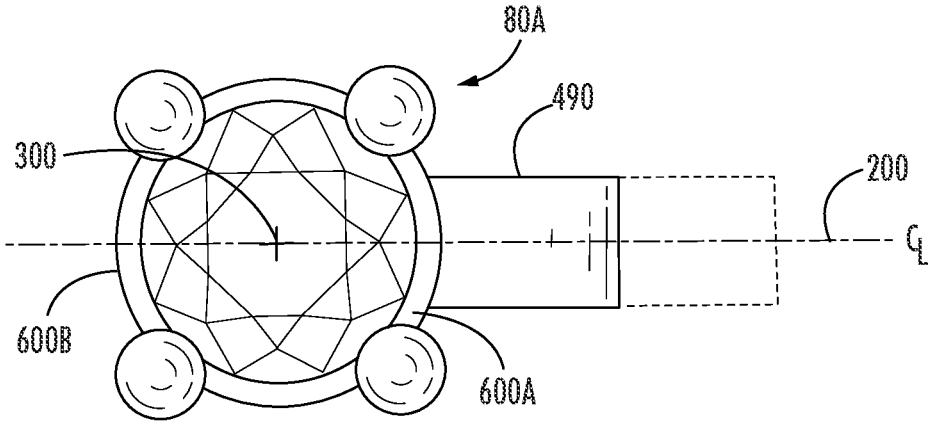
Figure 13E:
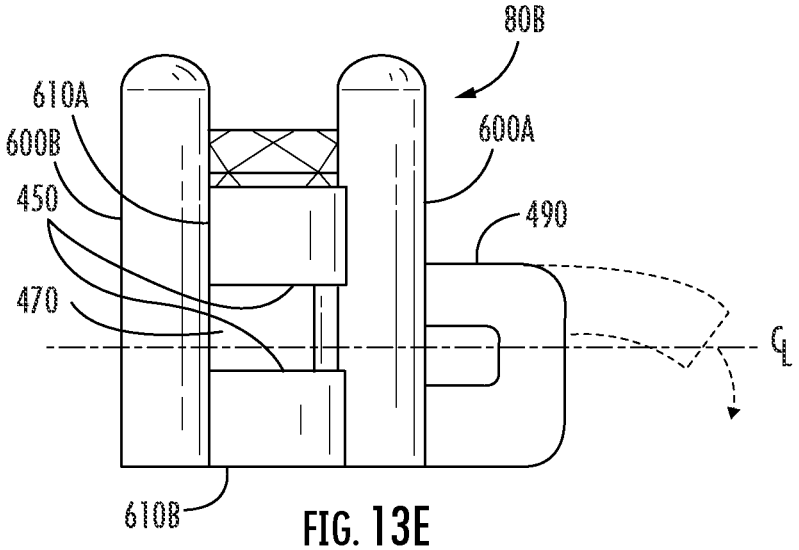
Figure 13F:
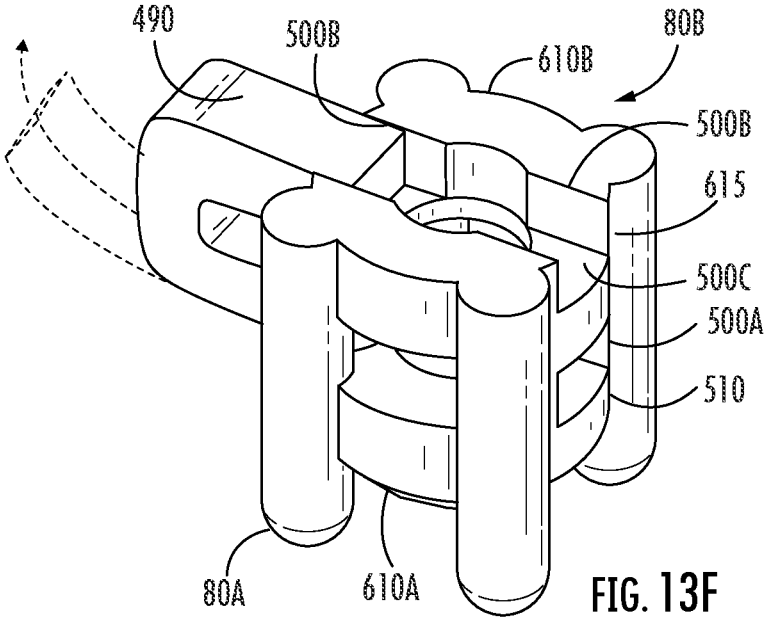
Figure 14A:
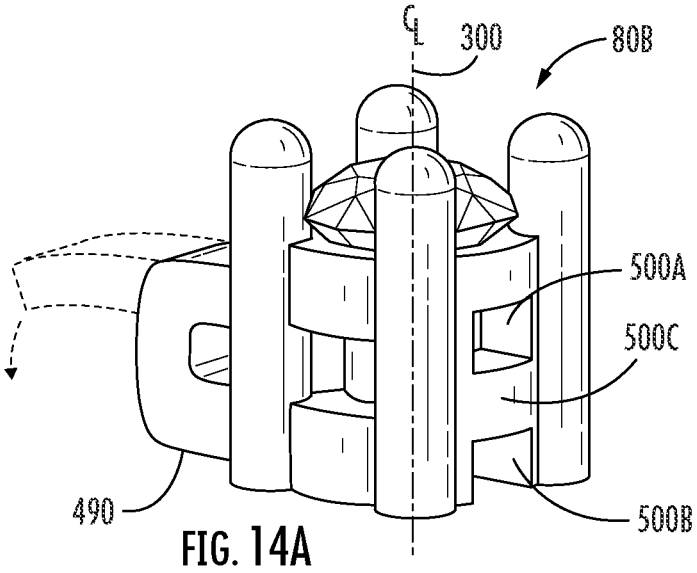
FIGS. 14A to 14F illustrate exemplary pull links left side joining a second converter link (left side) to the clasp element.
Figure 14B:
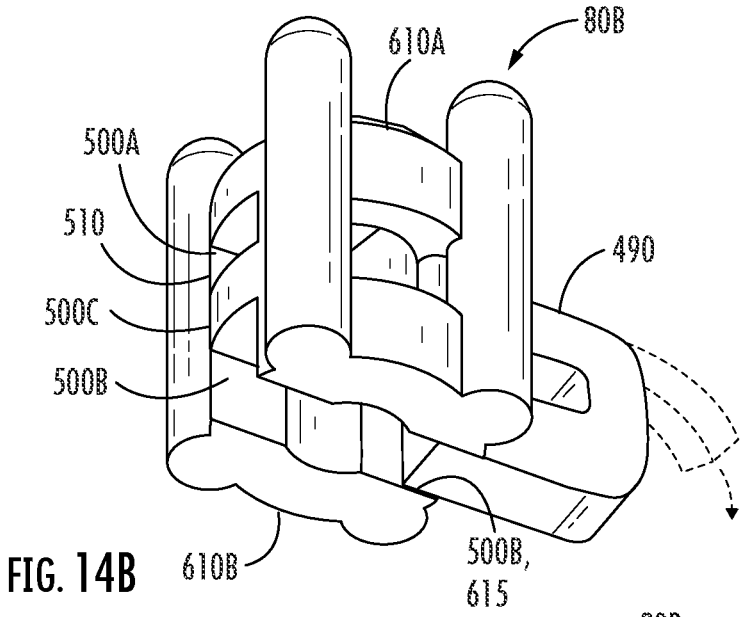
Figure 14C:
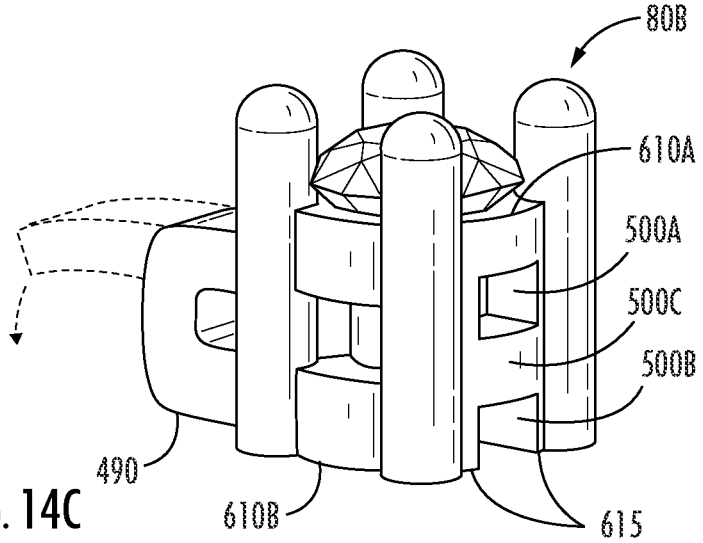
Figure 14D:
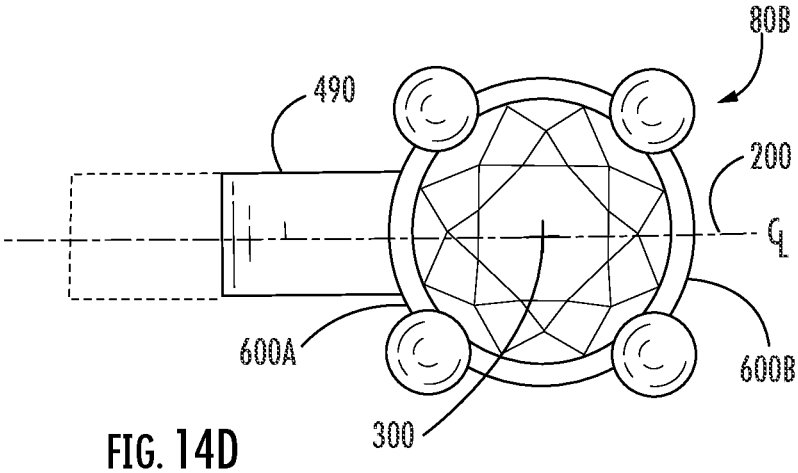
Figure 14E:
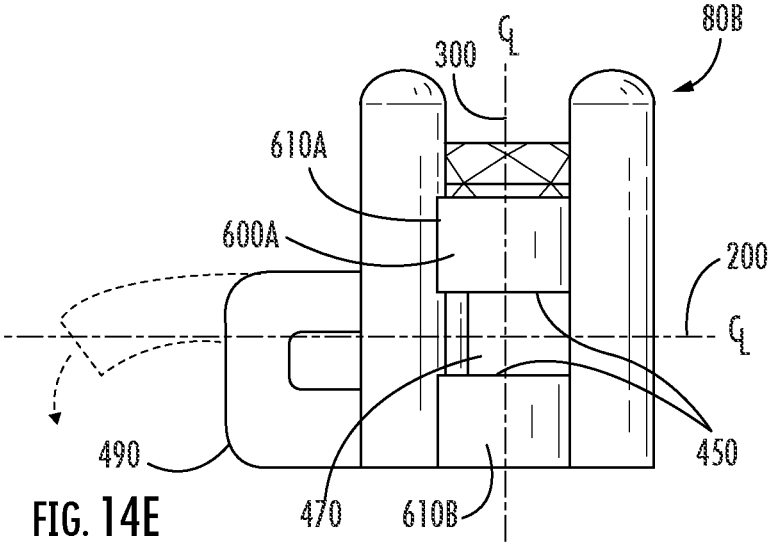
Figure 14F:
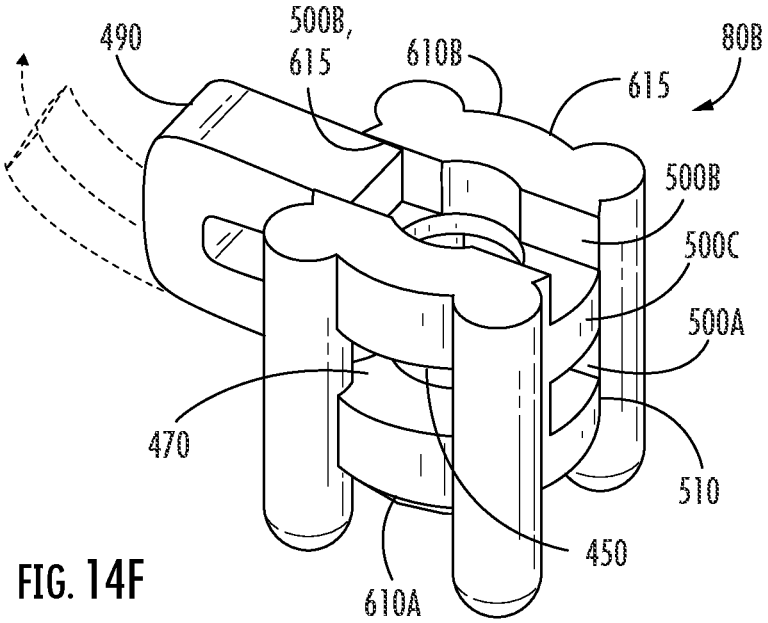
Figure 15A:
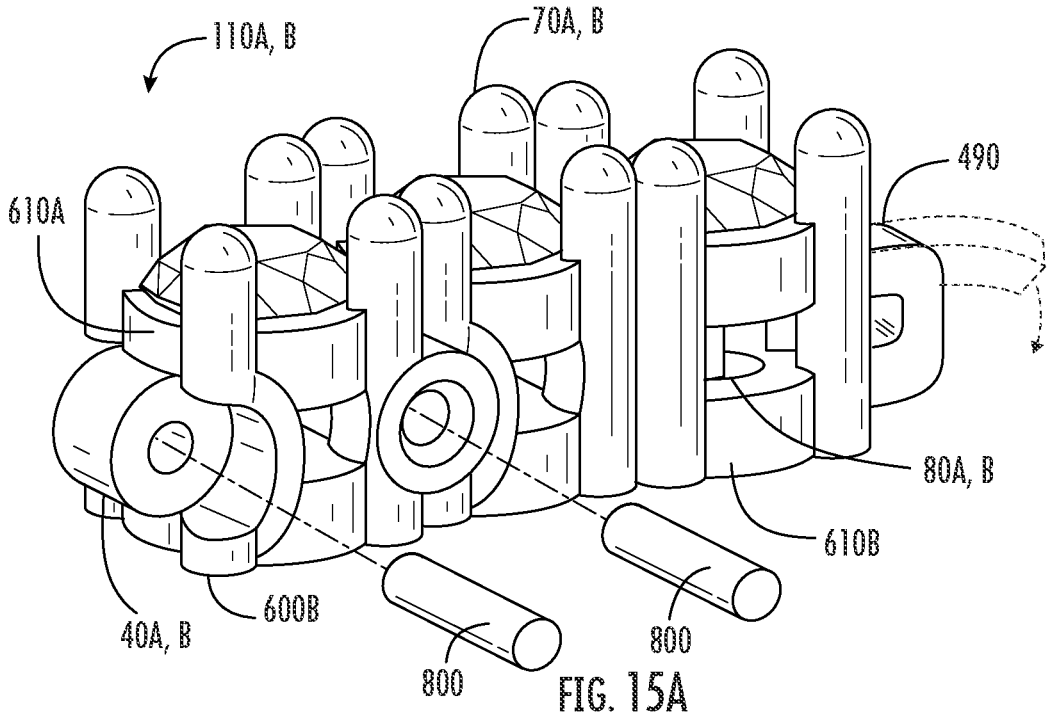
FIGS. 15A to 15E represent a top transition assembly between a pull link, second converter link, and a pin link, as shown to accommodate the segmented roll resistant necklace.
Figure 15B:
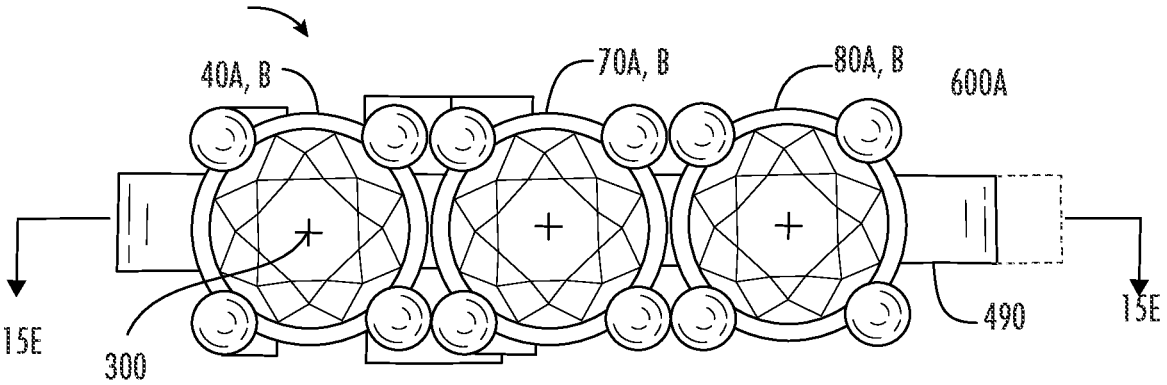
Figure 15C:
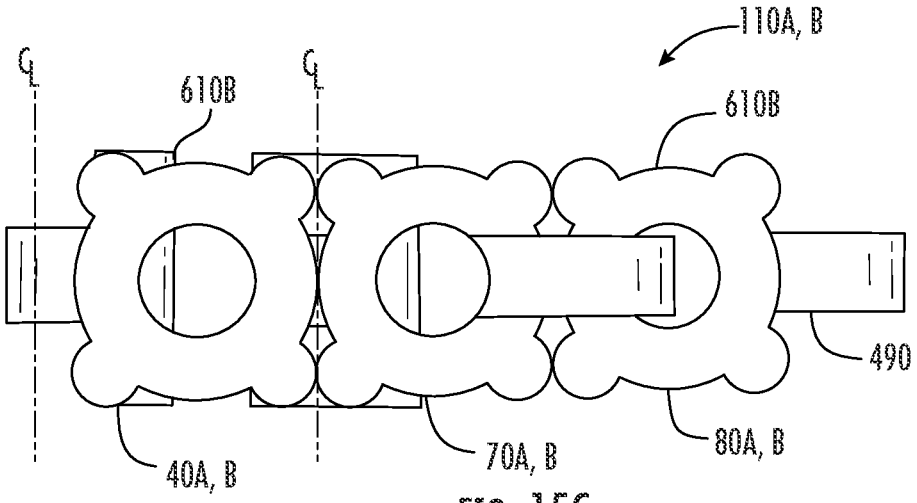
Figure 15D:
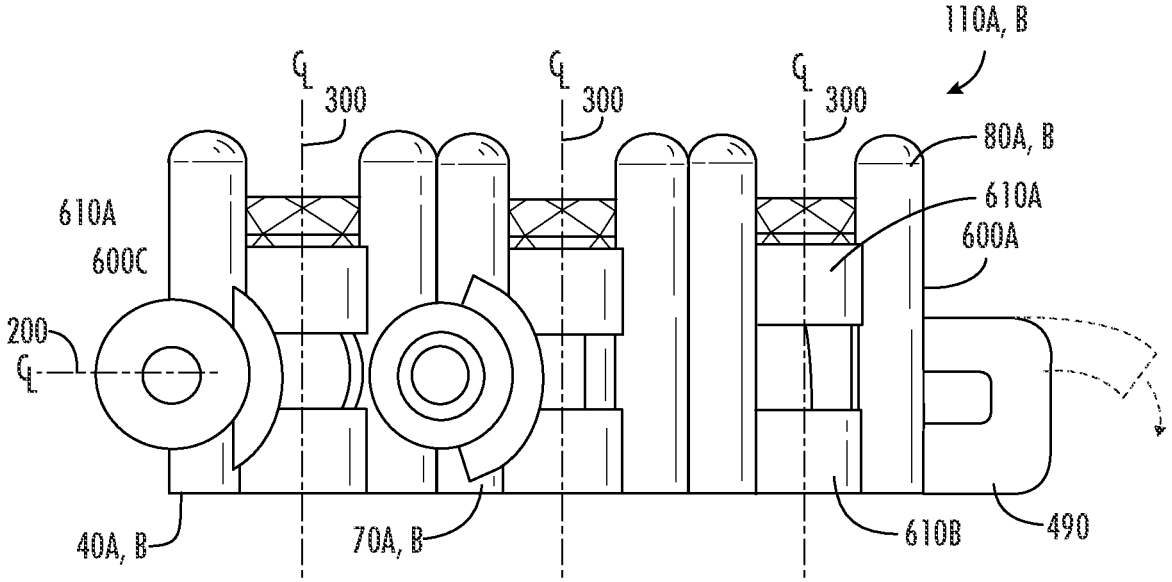
Figure 15E:
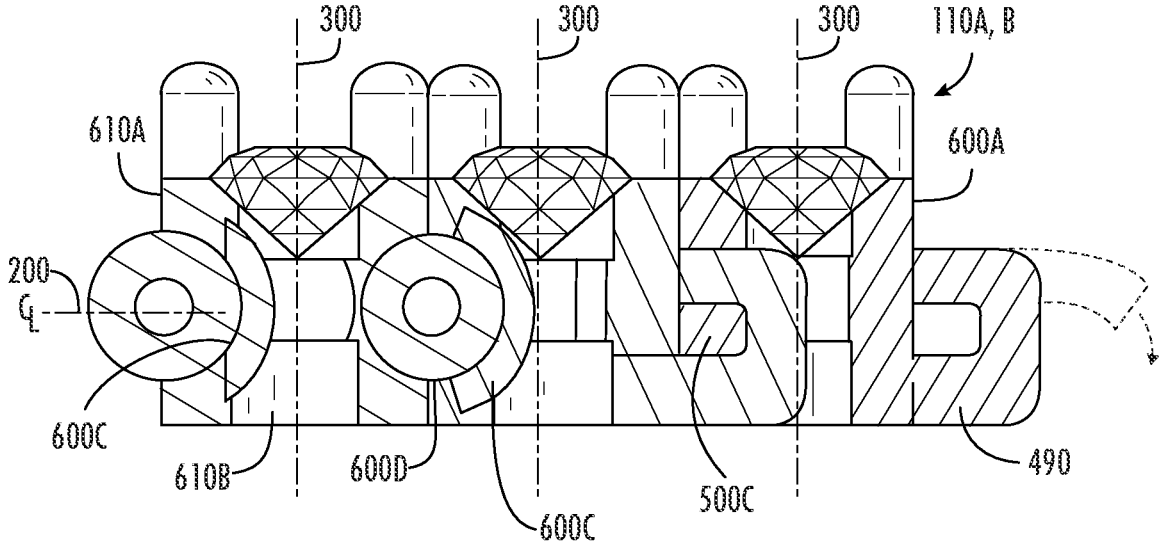
Figure 16A:
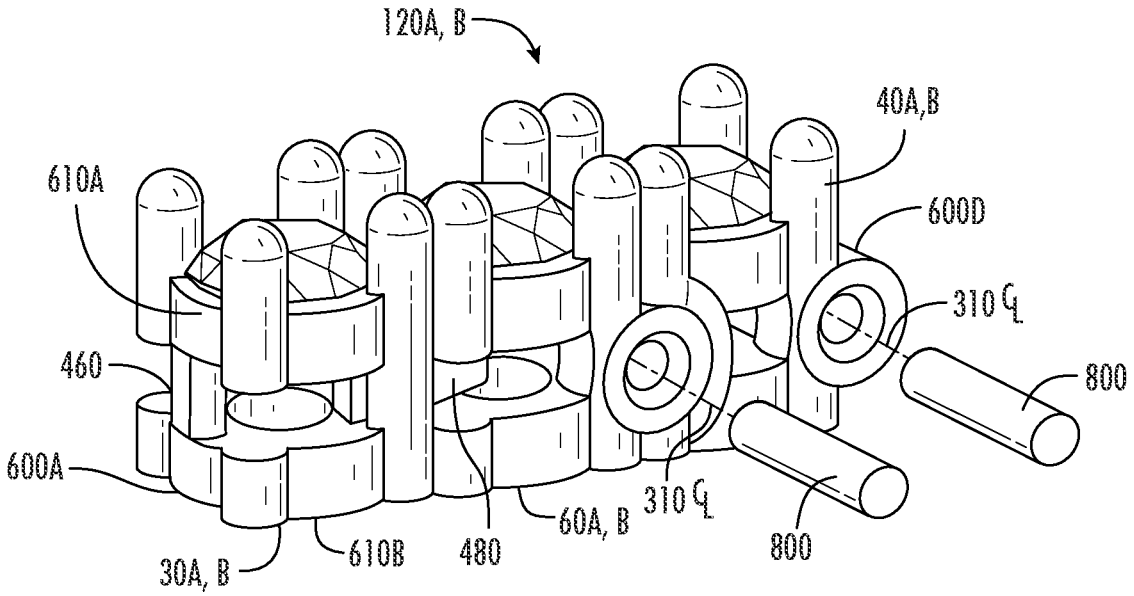
FIGS. 16A to 16F represent a bottom transition assembly between a center ring link left (or right mirror image), first converter link, and a pin link, as shown to accommodate a segmented roll resistant necklace of the present invention.
Figure 16B:
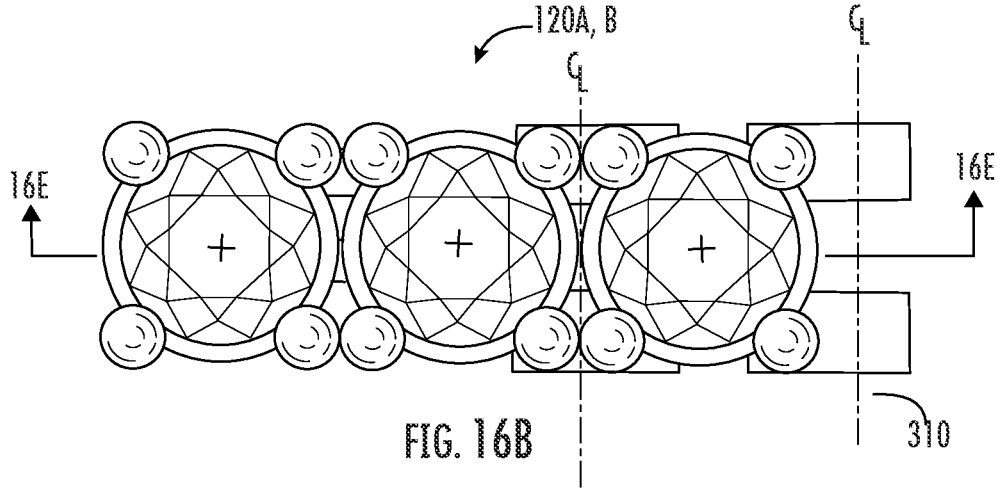
Figure 16C:
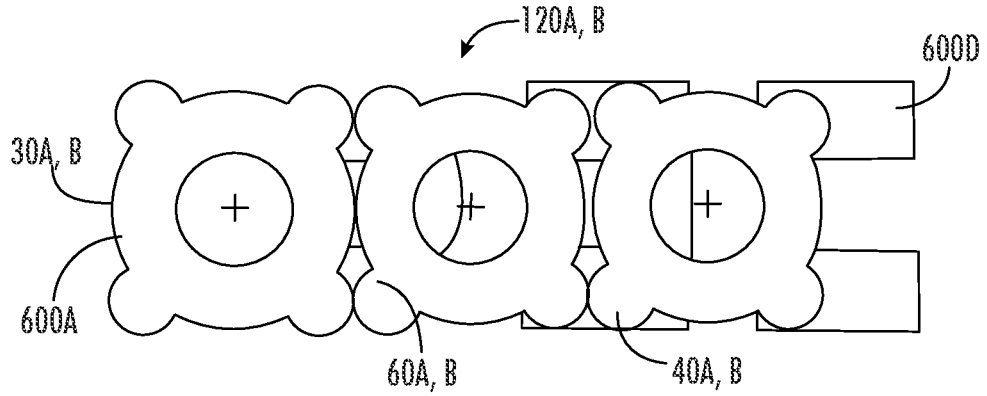
Figure 16D:
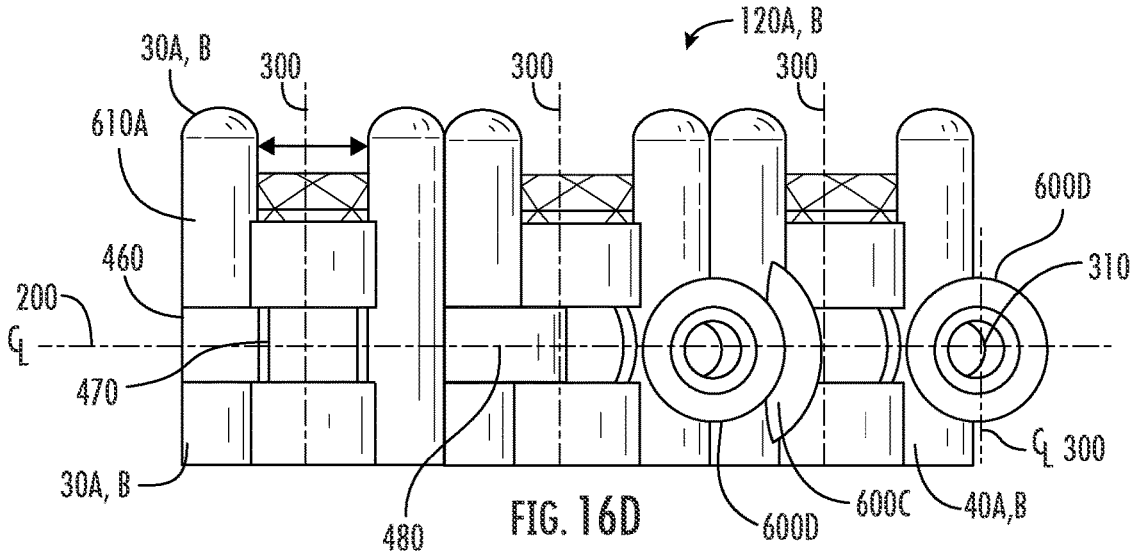
Figure 16E:
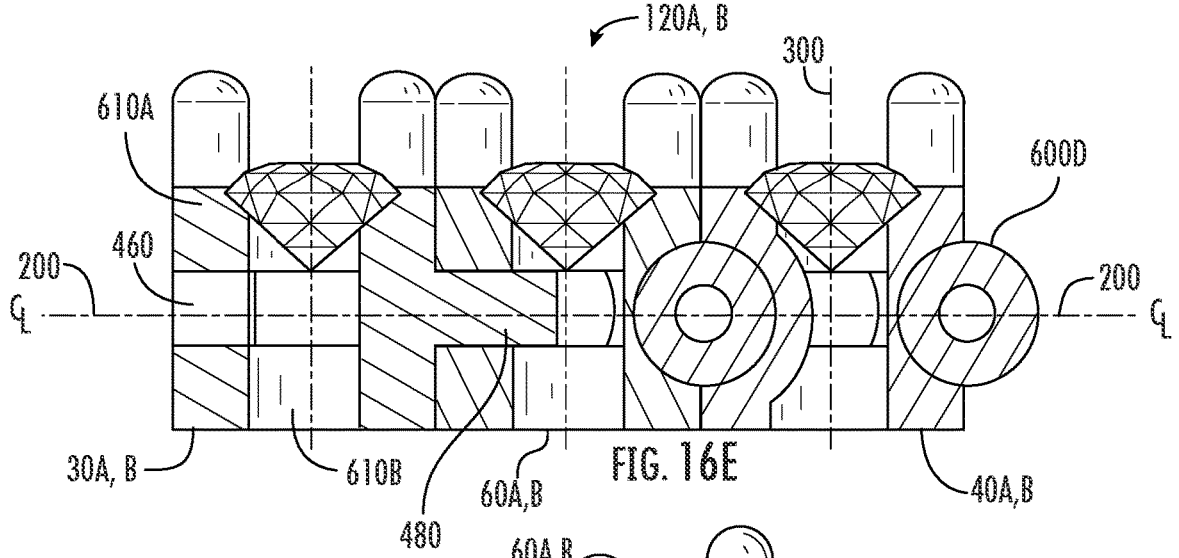
Figure 16F:
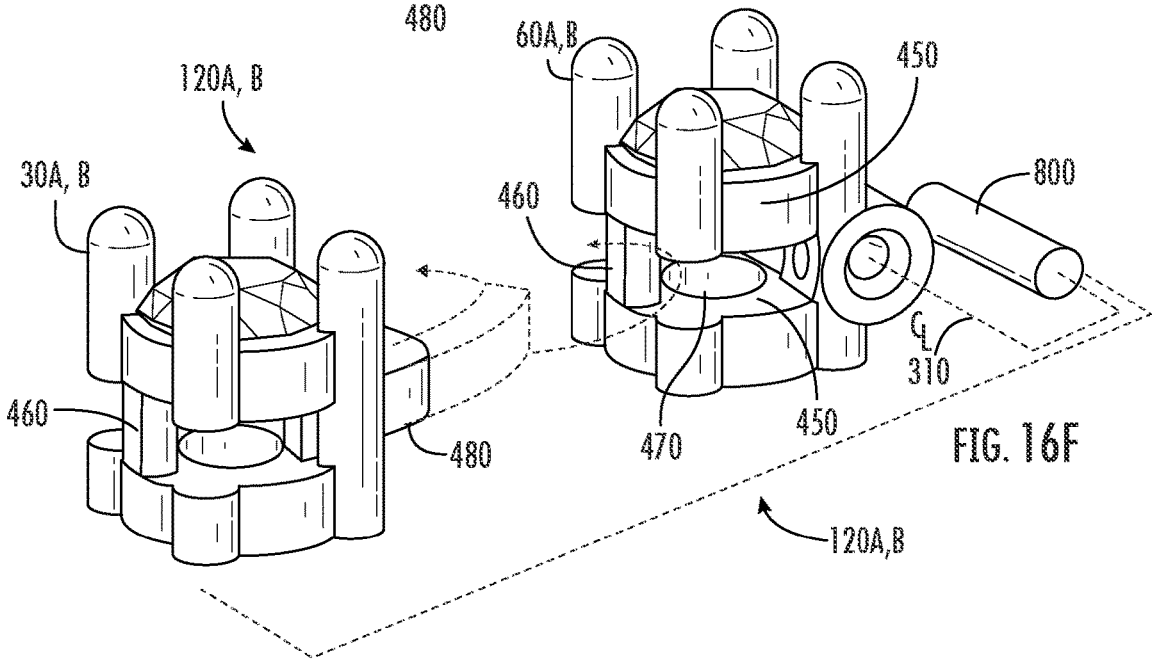
Figure 17A:
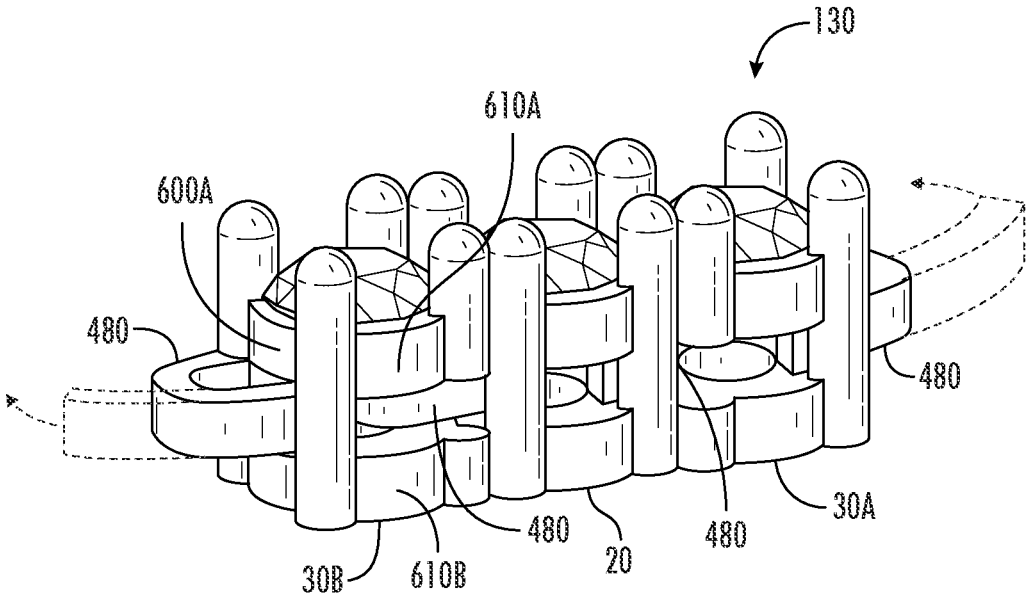
FIGS. 17A to 17F represent a ring link center transition assembly 130 or a ring link transition assembly 130 (See FIG. 4) between a full center ring link 20 and a respective left and right center ring link 30A, 30B, as shown to accommodate a segmented roll resistant necklace of the present invention.
Figure 17B:
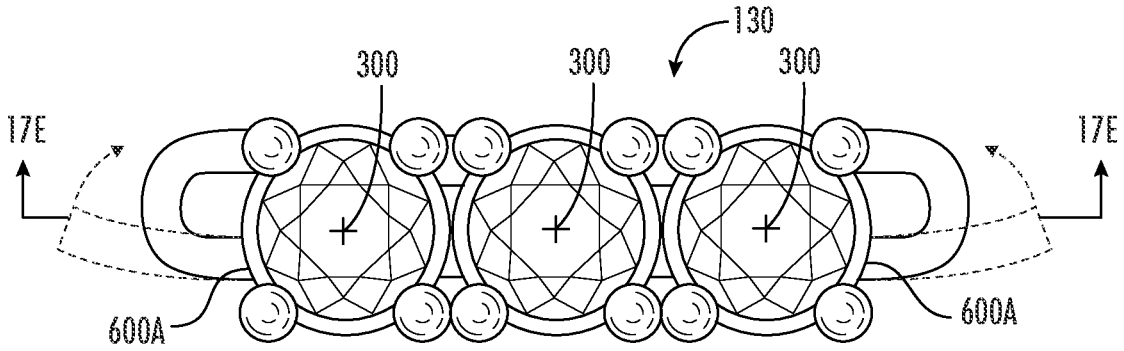
Figure 17C:
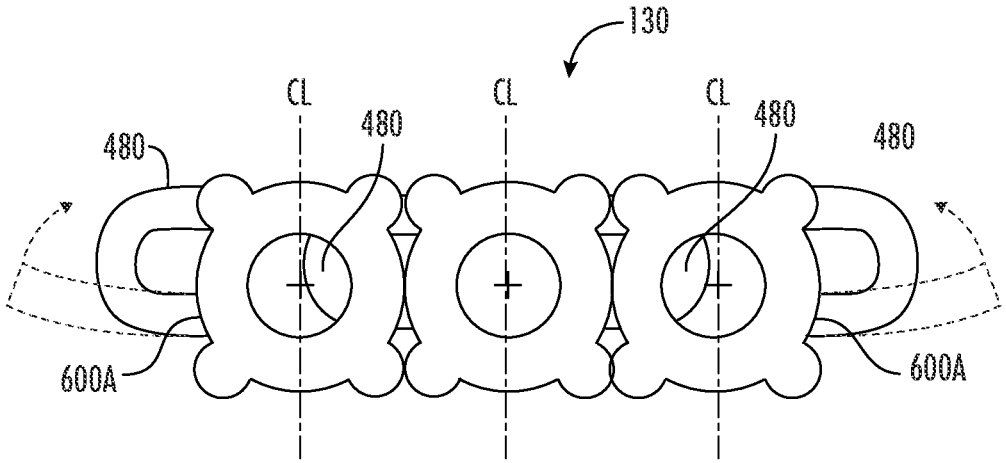
Figure 17D:
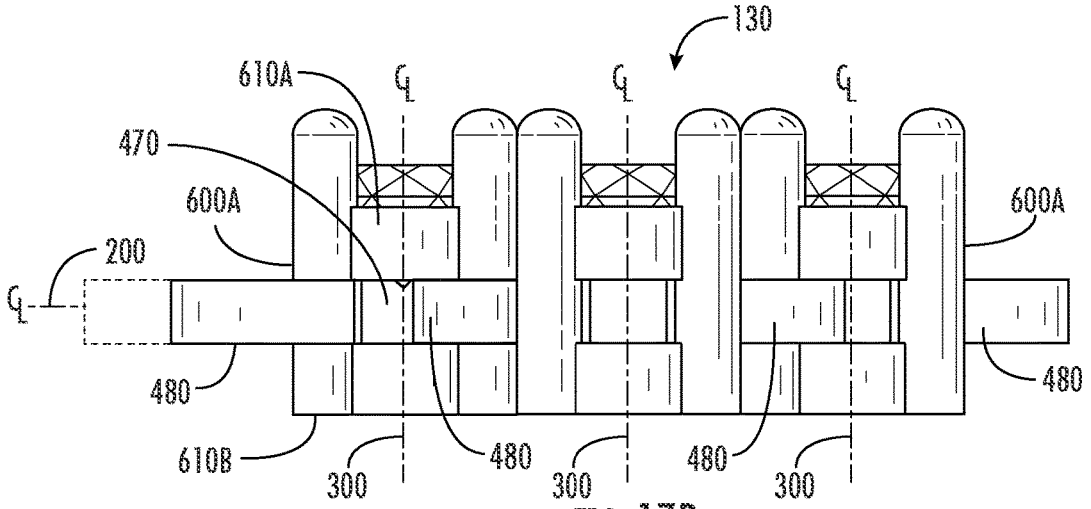
Figure 17E:
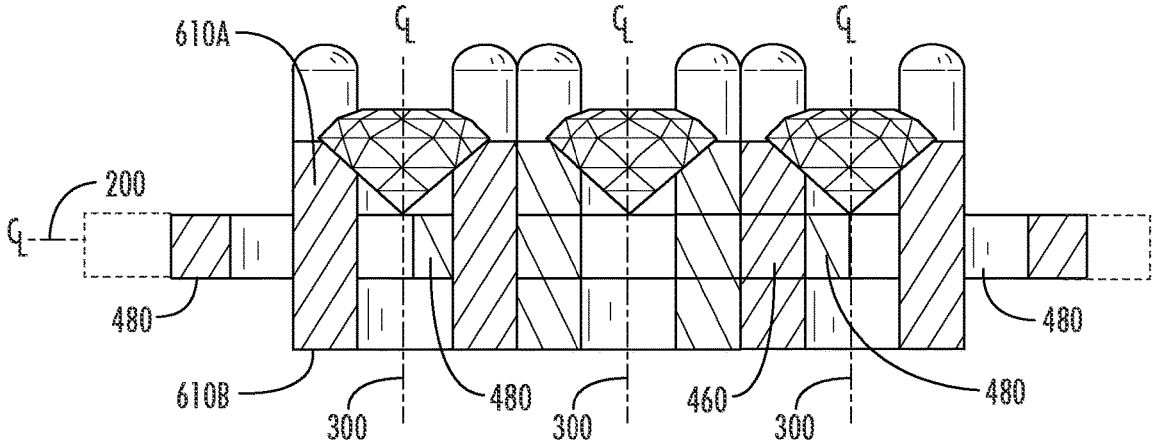
Figure 17F:
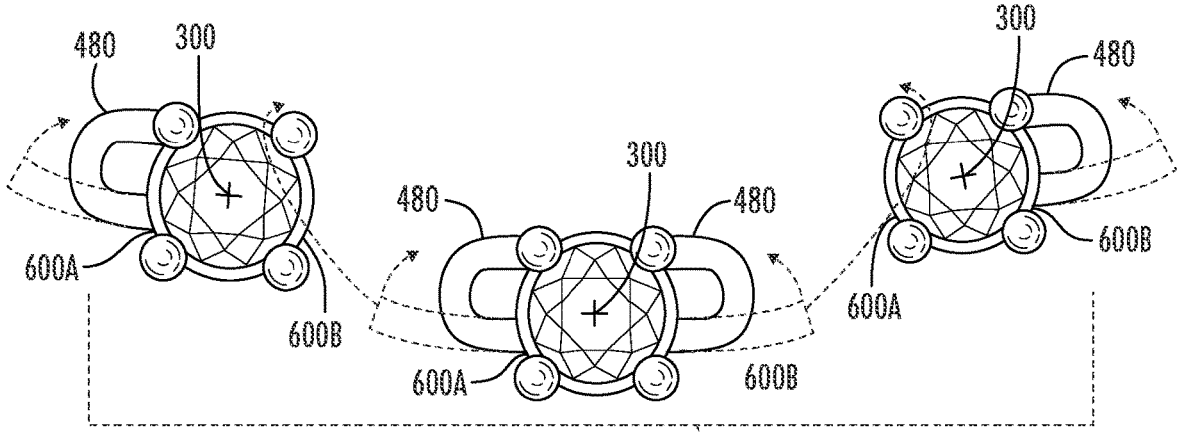

As noted throughout, respective links 20, 30A, 30B, 40A, 40B, 60A, 60B, 70A 70B, 80A, 80B, and optionally pull link clasp segments 80C of clasp 90, are generally arranged with an upper facing link indicia platform 610A spaced from a bottom link support base 610B forming a cantilever brace side slot 470 therebetween having respectively parallel side slot contact surfaces 450 (See FIGS. 6E, 7G, and 8C, for example and others) so that the side slots 470 are understood as formed between indicia platform 610A and bottom link support base 610B and have parallel contacting surfaces 450, 450 (See FIGS. 11B-11C for example) for engaging as will be noted without restriction by reference to the figures.

Bottom link support bases 610 are generally a flat surface contact face (as shown, but may be in any form effective to be suitable for a comfort wearing fit). As shown (see Example FIG. 6A), a jewel is positioned on link indicia platforms 610A in a preferred embodiment but the invention is not limited thereto and any form of indicia, decoration, or other attractive arrangement may be provided and will be understood to be within the scope of the present disclosure, for example a decorative (non-jewel) surface or a multi-jewel (or combined decorative and jewel) surface 610A may be used without departing from the scope and spirit of the present invention.

Referring further now to FIGS. 4, 6A-6E, 7A-7A, 8A-8C, 13A-13F, 14A-14F, and to center ring link 20 and respective left and right center ring links 30A, 30B, respective left and right pull links 80A, 80B, (and the other related links incorporated herein); each link as shown contains a short pivot axis 300 that is perpendicular to the link support base 610B and necklace long axis 400. The links noted include a first link contact surface 600A (or contact surfaces 600A (see FIG. 7C)) opposite a second link contact surface 600B (or contact surfaces 600B (see FIG. 7C) where no pivoting is intended as each link contact surface 600A, 600B establishes a contact surface which is generally aligned parallel to the link short pivot axis 300 (see for example FIGS. 15A-15C where the contact surface (or surfaces) contact each other and prevent relative divergence from axes 300) whereby, when links 20, 30A, 30B, and 70A, and 70B (and others) are joined adjacent (respectively) to each other (or to other links as discussed herein), link contact surface(s) 600A, 600B are in a guiding contact with one another to resist a respective relative roll between respective links between short pivot axes 300 (as shown because the links are in direct contact), thereby collectively resisting a collective roll along segmented necklace 400 and along necklace long pivot axis 200. In this manner, any rotation that is intended to occur (draping along a user in the bend section) as will be discussed through bend section (FIG. 4) along left and right pin links 40A, 40B and respective transition assemblies 110A, 100B, 120A, 120B and will not roll along the long axis 200 so as to ensure the indicia surfaces (See FIG. 6A and indicia platform 610A) are facing outwardly for viewing. It is noted that in respective pin links right and left 40A, 40B and respective converter links 60A, 60B, 70A, 70B there are identified link contact pivot side concave surfaces 600C and identified convex surfaces 600D, as shown. It will be further understood, by those of skill in the art having studied the entire disclosure that concave surfaces 600C and convex surfaces 600D operate to create hinge-link connections with pins 800 (see FIG. 9C for example), and also that inverting (or mirror images) will be understood as disclosed herein.

Center ring link 20 (See FIGS. 6A-6E) notes cantilever brace side slots 470 with contact surfaces 450 between respective top and bottom link indicia platform 610A and link support base 610B and two opposed extending cantilever slot arms 480, 480 extending away from slot 470. Each cantilever slot arm 480 is shown (dashed-lines extended) and bent (solid lines) formed with top and bottom surface that are shaped to slidingly engage with respective contact surfaces 450, when bent over and placed within side slot 470 and also extend in parallel with necklace long pivot axis 20. In this way, each cantilever slot arms 480 extend and secure through contact to other links while preventing relative rotation between links along long pivot axis 200 and securing respective links in series, as noted herein.

Figure 7A:
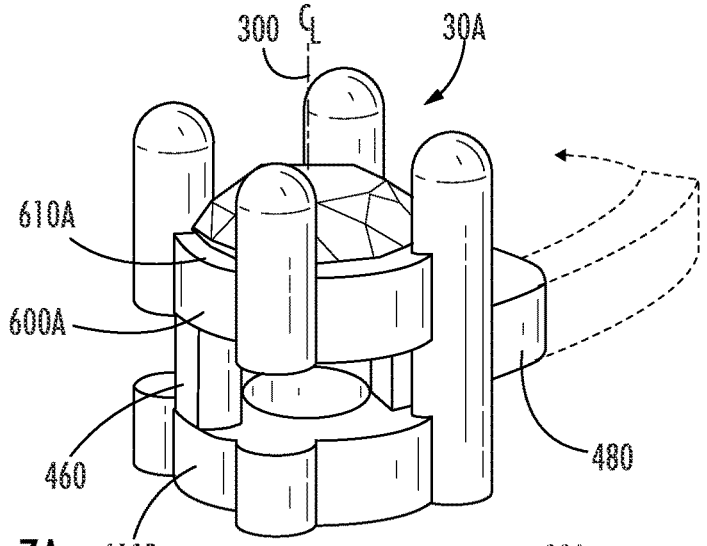
FIGS. 7A to 7H illustrate an exemplary center ring link right ring link segment used to join and connect a center ring link (dual ring link noted in FIG. 6A to FIG. 6E) and a first converter segment in an exemplary segmented roll resistant necklace for the proposed invention.
Figure 7B:
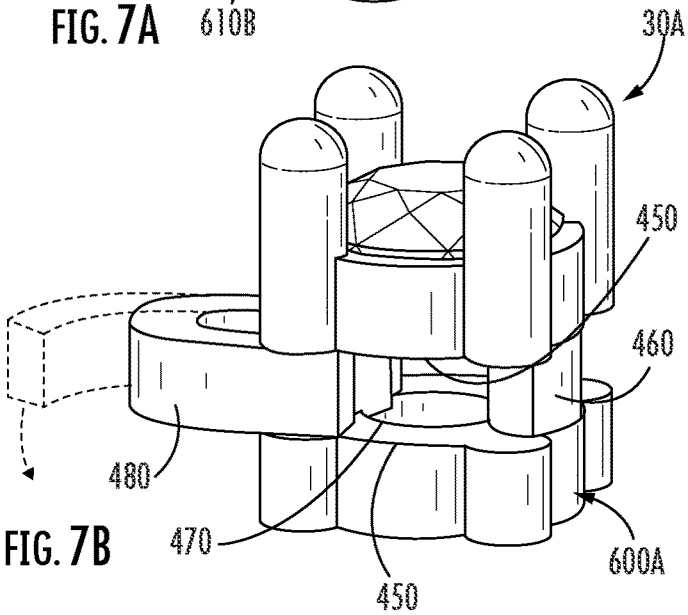
Figure 7C:
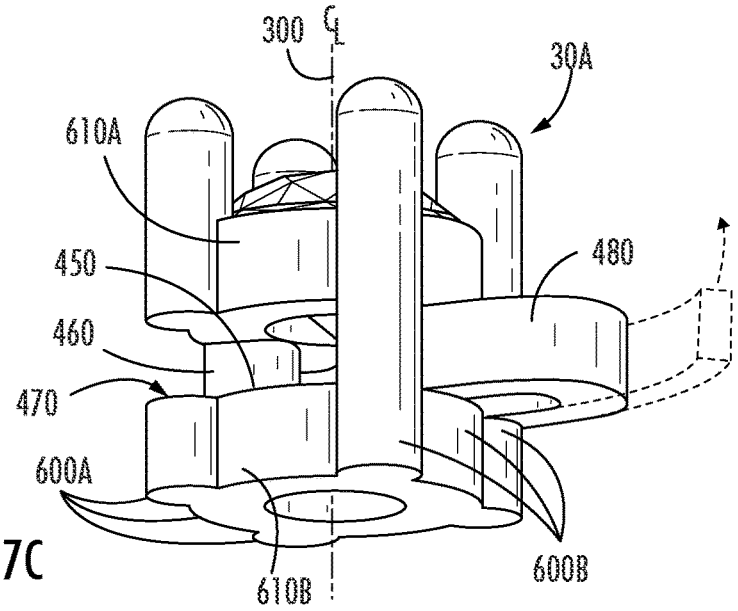
Figure 7D:
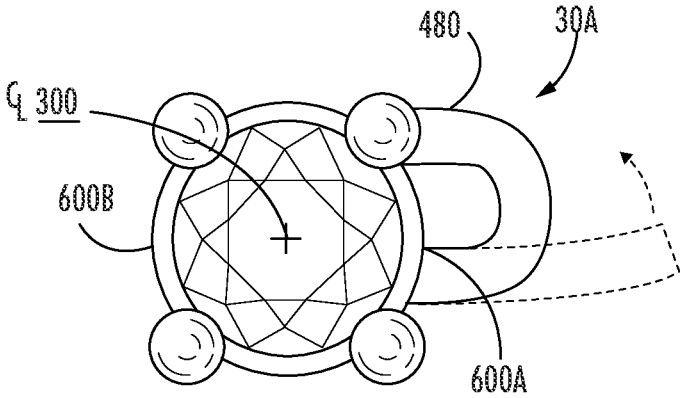
Figure 7E:
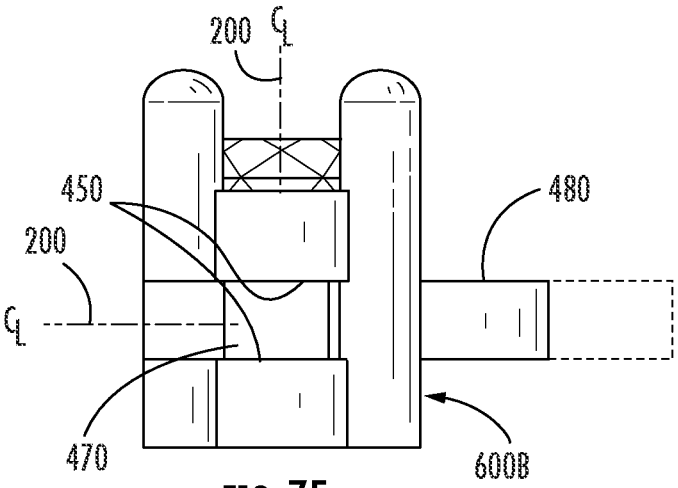
Figure 7F:
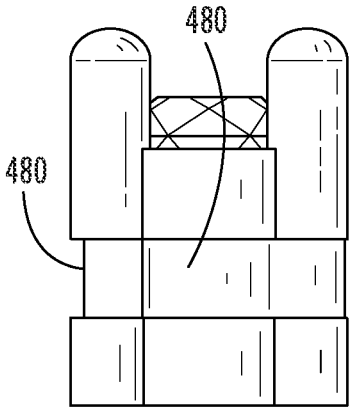
Figure 7G:
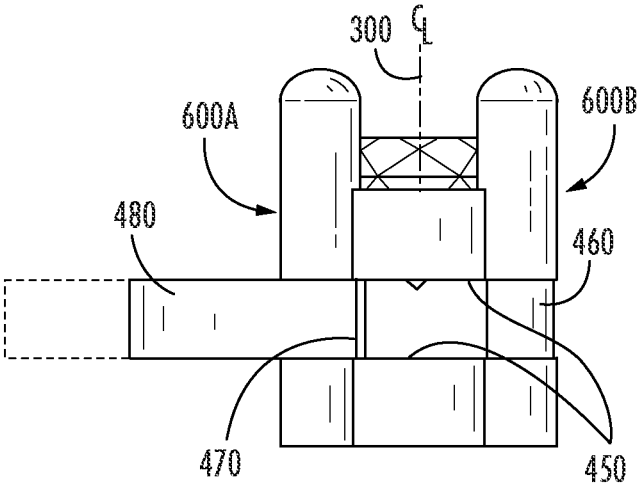
Figure 7H:
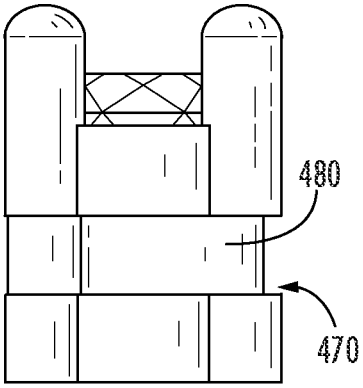
Figure 8A:
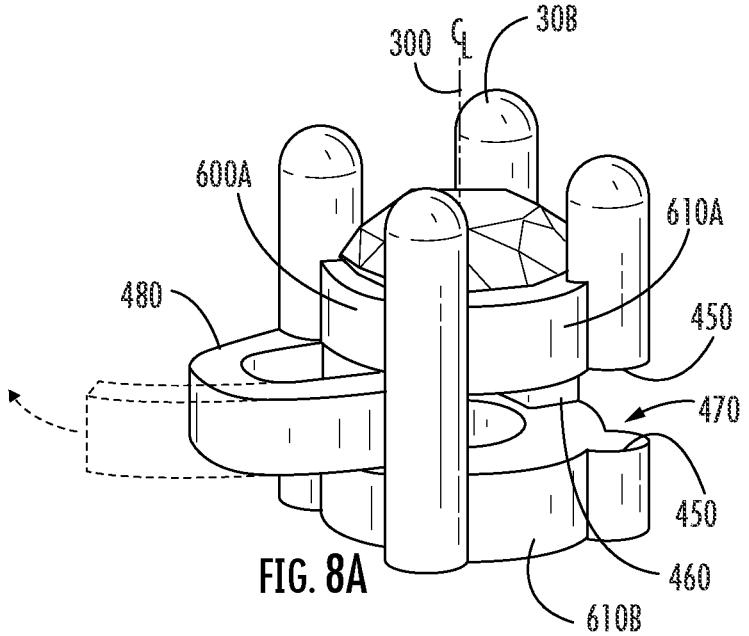
FIGS. 8A to 8C illustrate exemplary center ring link left ring link segment to join and connect a center ring link (dual ring link in FIG. 6A to FIG. 6E) with a first converter segment in an exemplary segmented roll resistant necklace for the proposed invention. The center ring link left is a mirror image of the center ring link right in FIGS. 7A to 7H as will be understood by those having studied the disclosure herein. As a result, mirror images (of FIG. 7A to FIG. 7H are minimized here). As illustrated
Figure 8B:
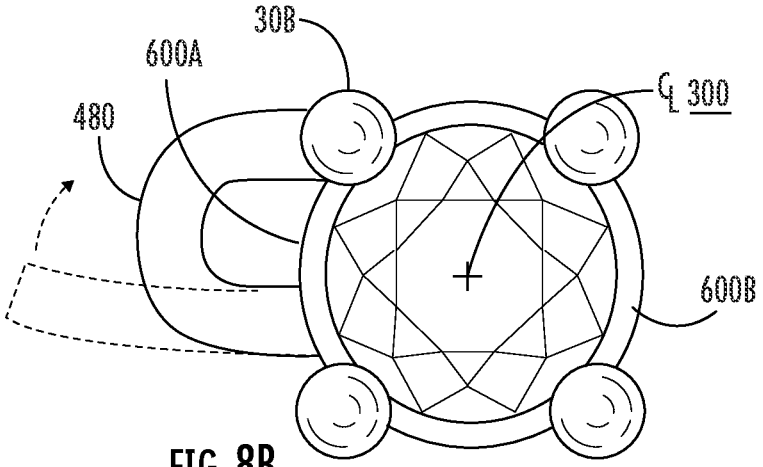
Figure 8C:
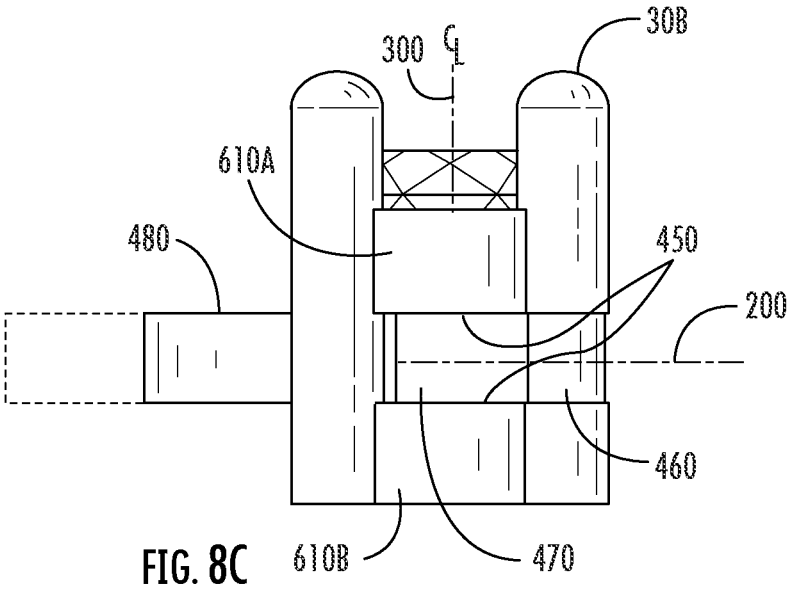

Referring now to respective center ring links left and right 30A, 30B, on either side of center ring link 20; each link 30A, 30B includes cantilever brace side slot 470 (as shown) between upper and lower platforms 610A, 610B and on one side an extending cantilever slot arm 480 (shown extended/un-bent in dashed form and bent/closed in solid line form) and bridging the cantilever brace side slot 470 (between upper and lower platforms 610A, 610B, See FIG. 8A) is a slot brace stub 460 (See FIG. 7B). As additionally noted in FIGS. 17A-17F and respective FIGS. 6A to 8C, during an assembly unbent cantilever slot arms 480 are slid within corresponding cantilever brace side slots 470 and around respective slot brace stubs 460 and then next bent further so that ends of each cantilever slot arm 480 bends around slot brace stubs 460 to rest within cantilever brace side slots 470, so as to secure respective links 30A, 30B to center ring link 20 and to each other while restraining a relative rotation between each link segment about necklace long pivot axis 200 by bracing between respective side slot surfaces 450 and cantilever slot arm 480 and also respective first and second link contact side surfaces 600A, 600B of the next-adjacent links (when joined together).

Referring further now to respective FIGS. 11A to 11F and FIGS. 16A to 16F and respective converter bottom links 60A, 60B on respective left sides and right sides. Again, it will be understood that converter bottom links 60A, 60B are effective mirrors of each other, so as to operatively join with respective center ring links right 30A and center ring links left 30B. Converter bottom links 60A, 60B include respective link top indicia platforms 610A and link support bases 610B forming the cantilever brace side slot 470 therebetween. A slot brace stub 460 spaces cantilever brace side slot 470, as shown on one link contact side surface (respectively either 600A or 600B depending on the left or right sides). Opposite the link contact surface 600A, B, is formed the link contact pivot side surface 600D (convex (protruding outwardly)) with protruding hinge wings (as shown) spacing a pivot opening to receive a protruding hinge member from a link contact pivot side surface 600C (concave (recessing inwardly)) as will be discussed. A pin pivot opening is provided through link contact pivot side surfaces 600D (as shown) having a pivot center line axis 310 along which a pin 800 is inserted to join a respective converter bottom link 60A, 60B with a respective pin link 40A, 40B (left, right) as shown herein. See for example, FIGS. 16F and 16A. It is noted that pivot center line axis 310 is perpendicular to both necklace long pivot axis 200 and link short pivot axis 300. During an assembly to form bottom transition assembly 120 with center ring links 30A, 30B, converter link bottoms 60A, 60B, and pin links 40A, 40B, cantilever slot arm 480 (generally un-bent) is passed end-first through cantilever brace side slot 470 and around slot brace stub 460 so that an end of cantilever slot arm 480 follows around slot brace stub 460 the end of cantilever slot arm 480 rests within slot 470 between link indicia platform 610A and link support base 610B. In this manner, one of skill in the art having appreciated the disclosure herein will recognize that the fit and assembly substantively prevents roll between center ring links 30A, 30B and bottom converter links 60A, 60B.

Figure 9A:
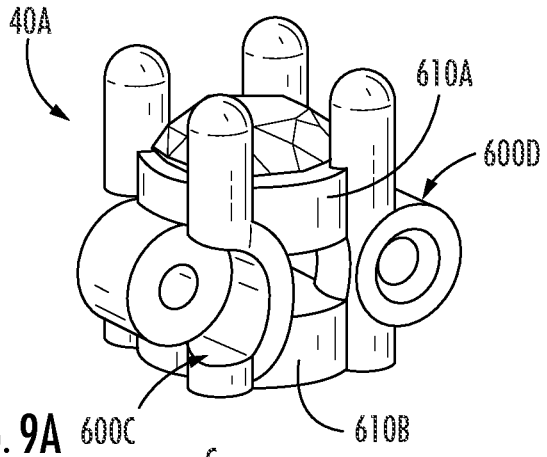
FIGS. 9A to 9F illustrate an exemplary pin link right segment used to operably connect and pivotably join segments from a first converter link (bottom) to a second converter link (upper/top) in an exemplary segmented roll resistant necklace for the proposed invention.
Figure 9B:
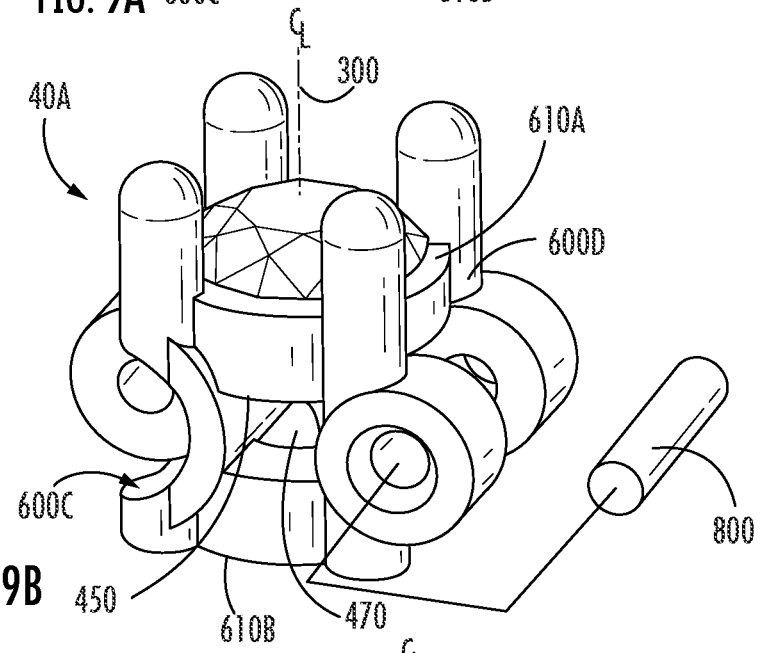
Figure 9C:
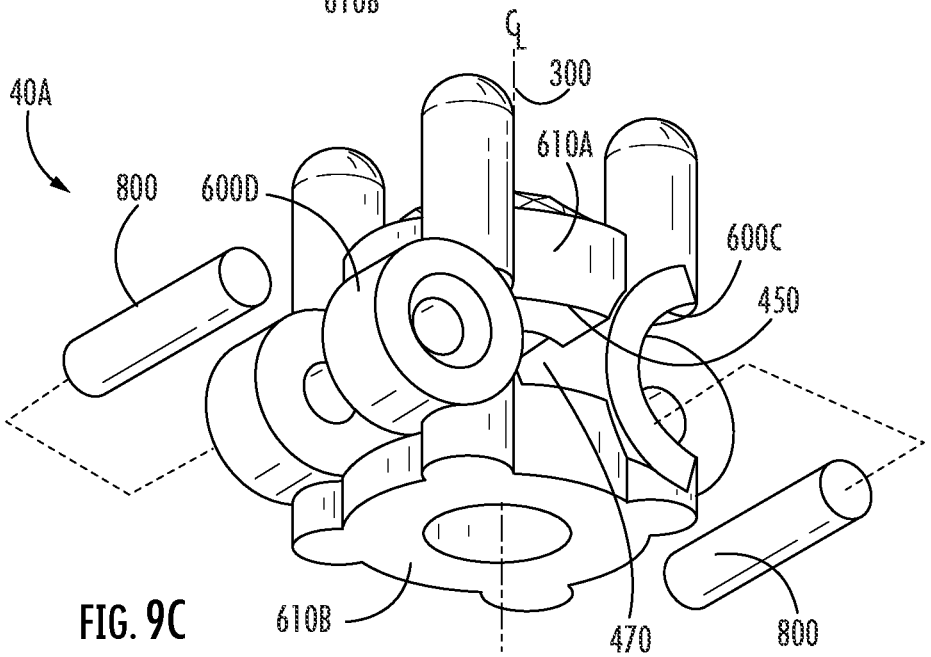
Figure 9D:
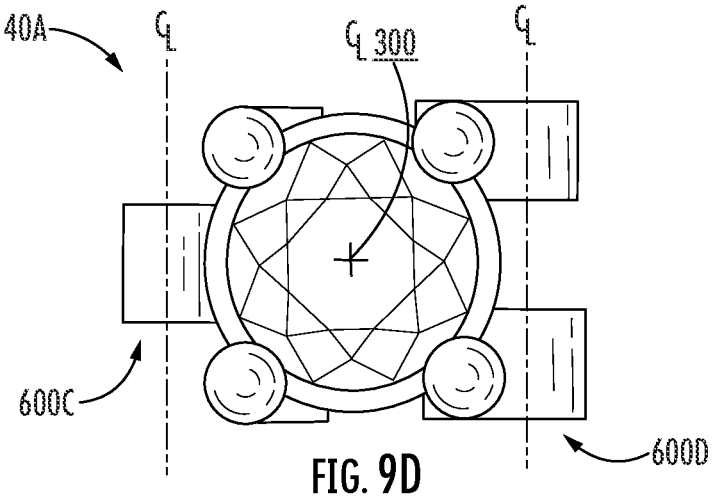
Figure 9E:
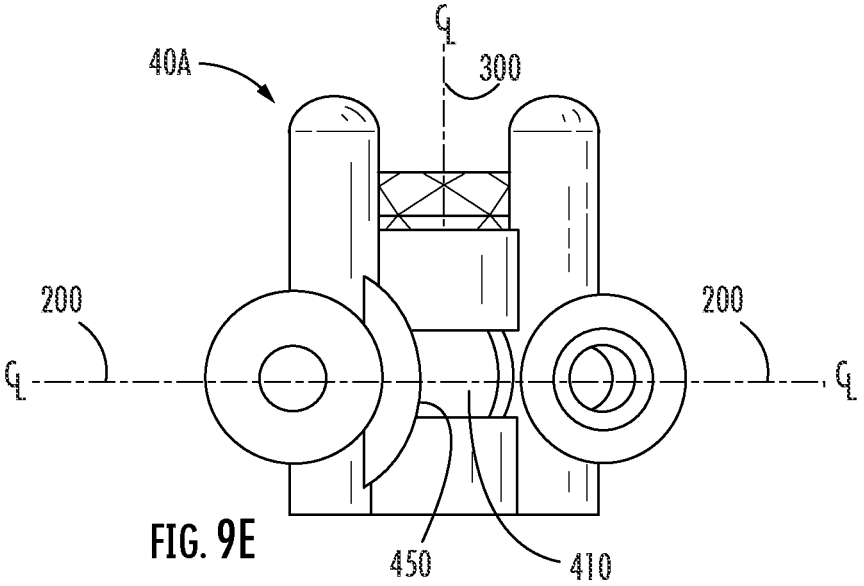
Figure 9F:
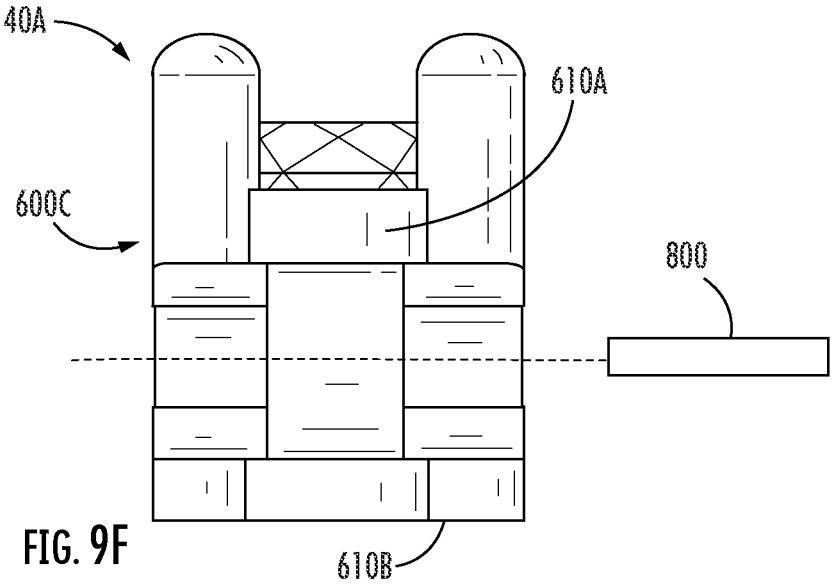
Figure 10A:
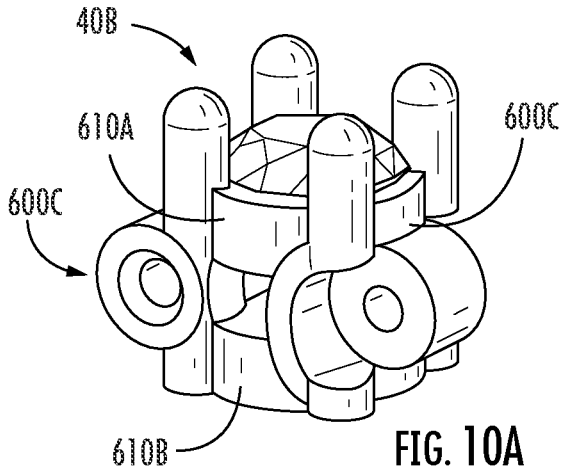
FIGS. 10A to 10F illustrate an exemplary pin link left segment used to join and pivotably join segments from a first converter link (bottom) to a second converter link (top) in an exemplary segmented roll resistant necklace for the proposed invention. As will be visible, pin link left segments in FIGS. 10A to 10F are rather mirror images of pin link right segments noted in FIGS. 9A to 9F so as to minimize roll and enable assembly.
Figure 10B:
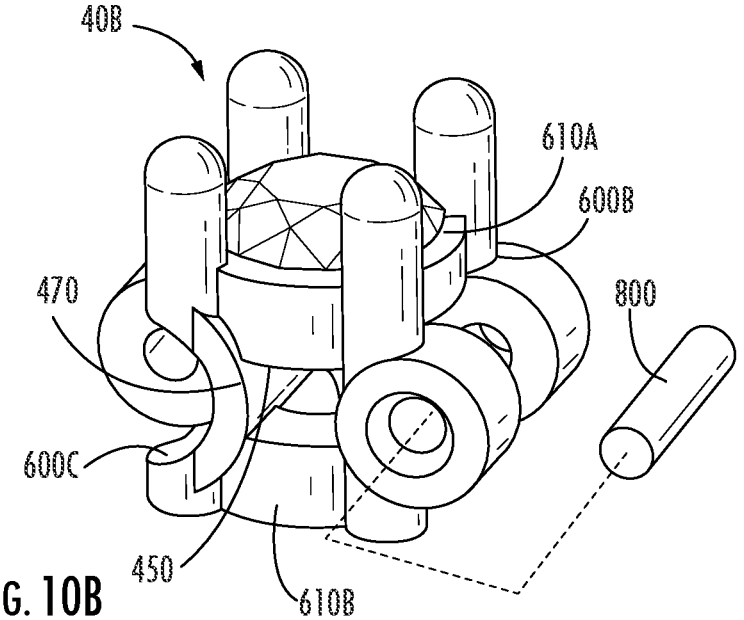
Figure 10C:
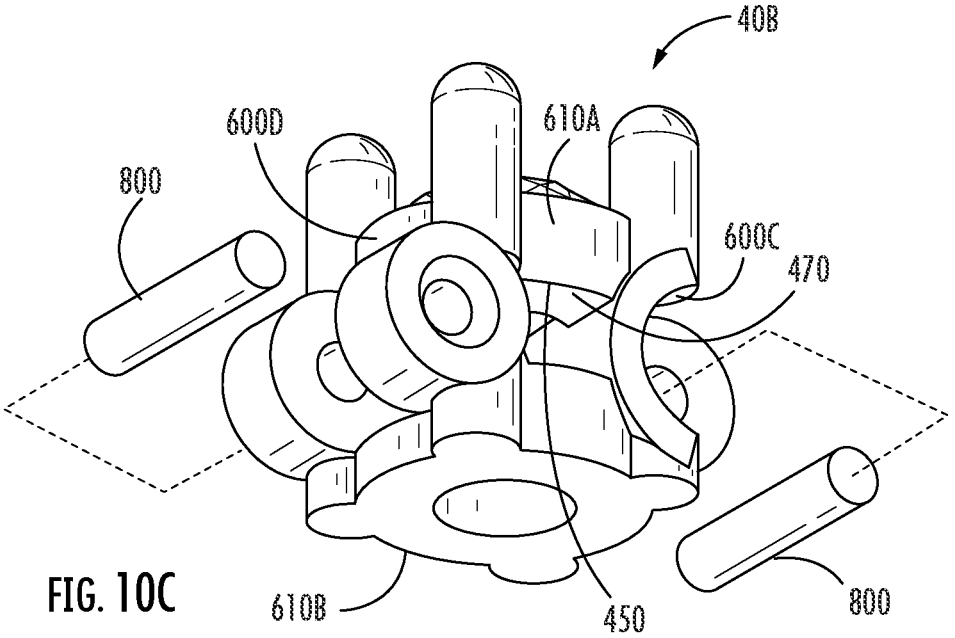
Figure 10D:
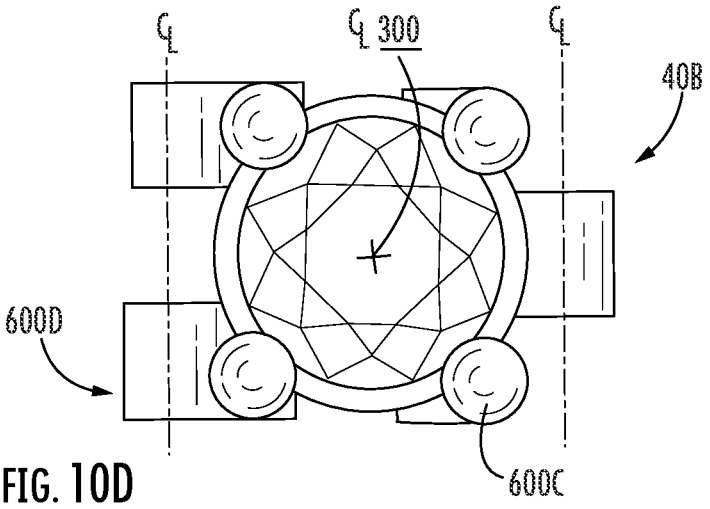
Figure 10E:
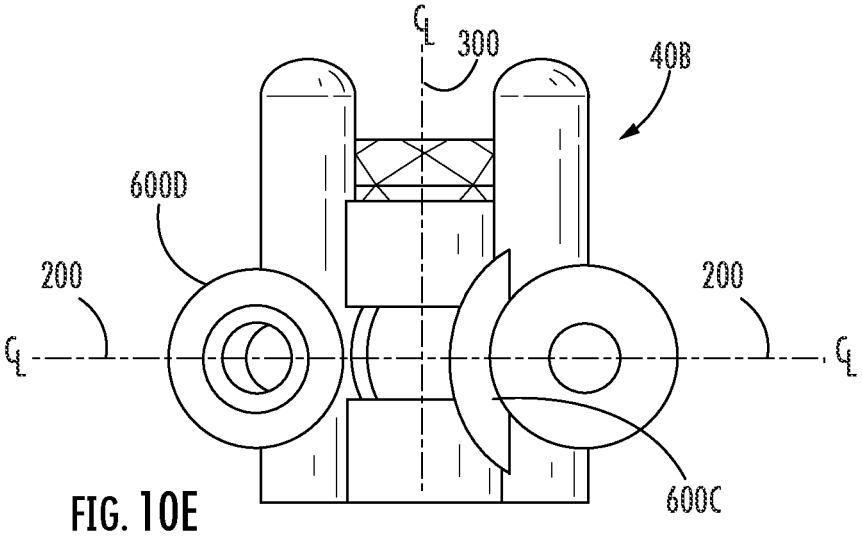
Figure 10F:
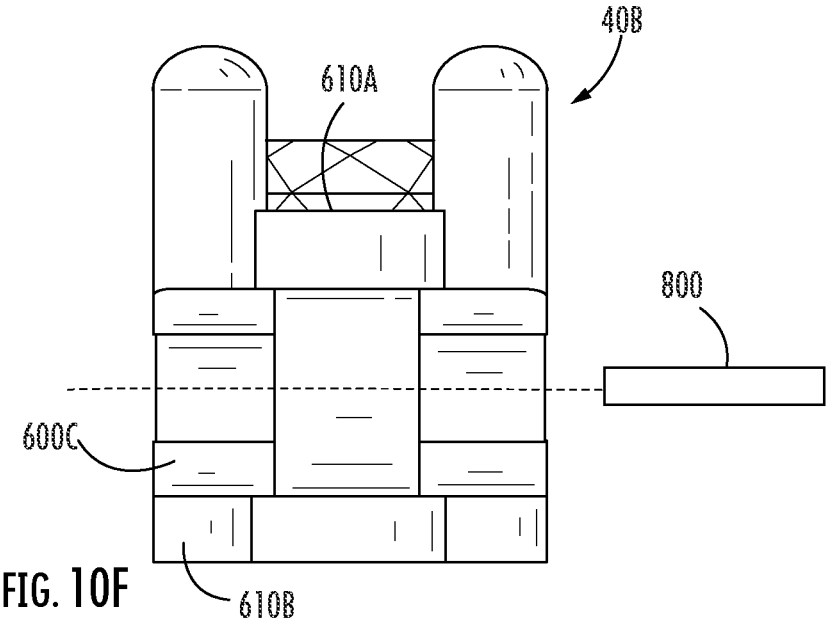

Referring further now to FIGS. 9A to 9F and 10A to 10F and related converter assemblies 120A, 120B and 110A and 110B, pin links right 40A and pin links left 40B are operative mirror images and each includes link indicia platforms 610A on top and link support bases 610B on the bottom spacing therebetween cantilever brace side slots 470 having respective slide slot contact surfaces 450, 450 on inner top and inner bottom surfaces (see for example FIGS. 9C, 9E). As noted earlier on a one side is a link contact pivot side surface 600D with convex hinge members (shown) bounding a pin opening with pin center line axis 310 for pivotably retaining pins 800, as shown. On the opposite side is link contact pivot side surface 600C with concave hinge elements with pin openings and respective pin center lines 310 and concave surfaces for pivotably receiving and guiding convex hinge elements from link contact pivot side surfaces 600D. At the bottom transition 120 bottom converters 60A, 60B have corresponding engagement surfaces to join with respective first engagement surfaces of respective pin links left and right 40A, 40B upon insertion of respective pins 800. As can be appreciated upon comprehension of the invention, respective pin links right and left 40A, 40B allow a slight pivot between respective link short pivot axes 300, in series relative to respective pin center line axes 310 and the inter-fit of respective link contact pivot side surfaces convex 600D and concave 600C through the bend section (See FIG. 4), so as to prohibit axial roll along necklace long pivot axis 200. It will be further understood that the respective links on left and right sides are mirror images of each other extending away from center ring link 20 or from clasp arrangement 90 so that respectively the elements, surfaces, platforms and bases and other features of respective links follow along the entire segmented necklace arrangement in an operative manner.

Referring further and additionally to FIGS. 12A to 12F, and related views, converter links top right 70A and right 70B are discussed and, similar to converter links bottom 60A, 60B, also have link indicia platforms 610A and link support bases 610B spacing cantilever brace side slots 470 with interior side slot contact surfaces 450, 450. Extending from cantilever brace side slots 470, on a first link contact side surface 600A, is a cantilever bar arm 490 shown bent closed (solid lines) and in an unbent-pre-assembled position (dashed lines), as will be discussed. As noted on link support base 610B there is provided a similar brace bottom slot 500B having respective brace bottom slot contact surfaces 610 shaped to receive a distal end of cantilever arm bar 490 upon bending and engaging, as will be discussed. On a link contact pivot side concave surface 600C, opposite link contact side surface 600A, are formed the contact rotating surfaces for engaging with respective link contact pivot convex side surfaces 600D from respective pin links right and left 40A, 40B upon insertion of respective pins 800, as will be understood during assembly of necklace 400.

Referring further and additionally to FIGS. 13A to 14F, and FIGS. 15A to 15E, respective pull links left and right 80A, 80B are further described and related to right and left top transition assemblies 110A, 110B. Respective pull links 80A, 80B have respective link indicia platforms 610A above link support bases 610B spacing cantilever brace side slots 470, as shown. On first sides of respective pull links 80A, 80B are first link contact side surfaces 600A and oppositely are second link contact side surfaces 600B. Extending from a first link contact side 600A and from cantilever brace side slot 470 are cantilever bar arms 490 as shown (solid lines denote bent assembled position and dashed lines denote an extended pre-assembled position). On link support bases 610B are brace bottom slots 500B, 500B (shown on either side) with respective brace bottom slot contact surfaces 615 on either side thereof. One a side with cantilever bar arms 490 is therein below a brace bottom slot 500B (See for example, FIG. 14B) formed to receive a distal end of cantilever bar arms 490 upon an assembly. Also provided, opposite cantilever bar arms 490 are provided brace bar 500C forming brace holes 500A with respective bar hold contact surface 510 for receiving sliding engagement with cantilever bar arms 490 from pull links 80A, 80B and top converter links 70A, 70B, during an assembly between respective pull links 80A, 80B, cantilever bar arm 490 is extended and the distal end thereof passes through brace hole 500A in a respective link and is bent downwardly to be retained within respective brace bottom slots 500B having respective brace bottom slot contact surfaces 615. During this assembly, respective first and second link contact side surfaces 600A, 600B, of respective links are brought into contact so as to prevent a rotational displacement therebetween rotating either about necklace long pivot axis 200 or unintended displacement between relative link short pivot axes 300. Proximate the end of each pull link left and right 80A, 80B series the final cantilever bar arm 490 of each final pull link extends into brace hole 500A on each pull link clasp segment 80C (See FIG. 5F) and bent around the adjacent brace bar 500C to rest within the adjacent brace bottom slot 500B in each pull link clasp element 80C to secure either side of necklace assembly 400 to clasp 90 for operative use.

Referring further and additionally to FIGS. 17A to 17F wherein a center ring link transition assembly 130 (or center transition assembly 130) between a full center ring link 20 and a respective left and right center ring link 30A, 30B (See FIG. 4), as shown to accommodate a segmented roll resistant necklace of the present invention. As will be appreciated by one of skill in the present art having studied and considered the combined disclosure, respective side (left or right) center ring links 30A, 30B are provided as opposing sides (See FIG. 17F, top view), so as to allow respective cantilever slot arms 480 to be inserted and bent to slot brace stubs 460 (See FIGS. 7A, and 8C) to engage with respective left center ring links 30A and right center ring links 30B to complete the hang and curve section (See FIG. 4). In this manner the twist is restrained between links (by the upper and bottom slide slot contact surfaces 450, 450 of respective cantilever brace side slots 470 slidably retaining the surfaces of respective cantilever slot arms 480).

It will be understood by those of skill in the art, having studied and appreciated the disclosure herein, that the jewel/stone shown in the views along the top side of respective links, assemblies, and features is not restrictive, and may represent one or a plurality of jewels/stones or one or more other decorative indicia (polished/engraved/shaped surface), so as to enhance the visual appearance of the segmented roll resistant necklace system without restriction to the particular jewel, stone, decorative indicia, or optionally the need for the same to rest with the scope and spirit of the entire disclosure herein.

It will be recognized that the similar sections, grooves, assembly elements, and systems are operable in these additional embodiments, including forms in mirror images (left-to-right-mirror for links (for example pull links right 80A are mirrors of pull links left 80B but may be inverted depending on either side of clasp arrangement 90 and respective pull link clasp segments 80C etc.)) of each element or each section and are within those of skill in this art having studied and appreciated the present disclosure and resting within the scope and spirit of the entire disclosure. As a result, those of skill in this art, having appreciated and studied the present disclosure will recognize that the respective links (ring, dual ring, converters, pulls, center, pull link clasp segments, clasp arrangement, transition assemblies or otherwise) may be provided in left-or-right orientation and in respective versions to accommodate the inventive goals herein without departing from the scope and spirit of the present invention.

The phrase cephalocaudal is used mechanically-descriptively for an elongate, multi-segmented, joined-together-segment system from one end with a clasp to another end joining the clasp (either elongated or joined together in a loop from a top to a bottom in the loop). Therefore, the phrase cephalocaudal shall not be restricted to any specific or any medical use, but instead linguistically represents the respective transition length along the elongated (long) and multi-segmented (including looped) axis of the multi-segmented flexible necklace from a beginning to an end (whether or not joined at a connecting clasp). Therefore, as used herein, starting from either side of the clasp, it will be understood by those of skill in the art having studied the enclosed details and elements, that the present system is roll-resistant along the cephalocaudal length (long-axis length beginning to end) of the multi-segment-connected-necklace system; and this remains whether the necklace is clasped in a continuous loop (joined together) or when unclasped (e.g., laid out). As the respective elements (or segments) in the necklace are joined together as disclosed herein each respective element (or segment) resists relative rotation with the next element (or segment) relative to the long axis (cephalocaudal) of the necklace, while allowing relative pivoting therebetween so as to accommodate a wearer/user's body layout through multi-sections. In this way, the exposed ornamental section (e.g., stone location or indicia location) remains continuously visible to appreciation and will not roll to contact the support surface (e.g., roll over).

It will also be understood by those of skill in the art, having studied and appreciated the entire disclosure herein, that each of the respective links as used herein, including but not limited to ring links, dual ring links, converter links, pull links, clasp segments and transition assemblies may be provided additionally as the mirror images of the images shown, e.g., if a left ring link is shown then a mirror image right ring link is to be understood as described or provided where the projections/brace/openings, etc. are merely mirror images of those shown, without departing from the scope and spirit of the present invention so as to provide a continuous segmented roll resistant necklace system.

It will be further understood by those of skill in the art, having studied and appreciated the entire disclosure herein, that in various views dotting lines showing either a connection (e.g., between a pivot pin and a link, as in FIG. 9B) or between an extended (unbent) and fully bent position of one of the slot arms or bar arms, etc. positioned during an assembly into a bent position. As a result those of skill in this art, having appreciated the present disclosure, will understand the assembly method of inserting, bending, arranging to provide the entire arrangement as noted herein.

It will be further understood by those of skill in the art, having studied and appreciated the entire disclosure herein, that the disclosure further includes the method of assembly of the segmented roll resistant necklace as disclosed herein, including the methods of bending link elements and joining link elements together to form the entire assembly, without departing from the scope and spirit of the present invention.

REFERENCE CHARACTERS

1000 Conventional segmented necklace
400 Segmented roll resistant necklace
200 Necklace long pivot axis (long axis)
300 Link short pivot axis (short axis)
315 Pin center pivot axis
130, 120, 110 Transition assembly
90 Clasp arrangement segment
80 Pull link
70 Converter link
60 Converter link
40 Pin link
30 Center (side) ring links
20 Center ring link Having described at least one of the preferred embodiments of the present inventions with reference to the accompanying drawings, it will be apparent to those skilled that the invention is not limited to those precise embodiments, and that various modifications and variations can be made in the presently disclosed system without departing from the scope or spirit of the invention. Thus, it is intended that the present disclosure covers modifications and variations of this disclosure provided they come within the scope of the appended claims and their equivalents. To this end, those of skill in the is art having studied and appreciated the disclosure herein will understand that there is no restriction on the materials employed for any segment or indicia, or combinations of materials. For example, the segments may be metallic, and of any alloy, or nonmetallic and the indica may be of any nature (jewel, material, enamel, natural material, or otherwise) without limitation.

What is claimed is:

1. A segmented roll resistant necklace system, comprising:

a clasp arrangement having a first clasp end and a second clasp end;

a center ring link having a first side and a second side;

a plurality of center side ring links secured to each of said first side and said second side of said center ring link and extending away from said center ring link to respective first transition assemblies;

each said first transition assembly, further comprising:

a respective first converter link connected to a last one of said center side ring links and a respective pin link of a plurality of pin links on each respective first and said second side;

a plurality of pull links secured to each said clasp end and extending away from said clasp arrangement to a respective second transition assembly;

each said second transition assembly, further comprising:

a respective second converter link connected to an end of said plurality of pull links; and a last one of said plurality of pin links connected to said second converter link.

2. The segmented roll resistant necklace system, according to claim 1, further comprising:

a pull link clasp segment on each of said first clasp end and said second clasp end; and said plurality of pull links extending from respective said first clasp end and said second clasp end.

3. The segmented roll resistant necklace system, according to claim 1, wherein:

each said pull link, further comprises:

a brace hole on a first pull link contact side; and a cantilever bar arm on a second pull link contact side.

4. The segmented roll resistant necklace system, according to claim 1, wherein:

each said first converter link, further comprises:

a cantilever slot brace stub on a first contact side of said converter link; and a convex link contact pivot side surface on a second side surface of said first converter link.

5. The segmented roll resistant necklace system, according to claim 1, wherein:

each said second converter link, further comprises:

a cantilever bar arm on a first contact side of said second converter link; and a concave link contact pivot side surface on a second side surface of said second converter link.

6. The segmented roll resistant necklace system, according to claim 1, wherein:

each said pin link, further comprises:

a convex link contact pivot side surface on a first contact side of said pin link; and a convex link contact pivot side surface on a second contact side of said pin link.

7. The segmented roll resistant necklace system, according to claim 1, wherein:

each said side ring link, further comprises:

a cantilever slot brace stub on a first ring link contact side; and a cantilever bar arm on a second ring link contact side.

8. The segmented roll resistant necklace system, according to claim 1, wherein:

said center ring link, further comprises:

a first cantilever slot arm extending from a first contact side of said center ring link; and a second cantilever slot arm extending from a second contact side of said center ring link.

9. A segmented roll resistant necklace system, comprising:

a clasp arrangement having a first clasp end and a second clasp end;

a center ring link having a first side and a second side;

a plurality of center side ring links secured to each of said first side and said second side of said center ring link and extending away from said center ring link to respective first transition assemblies;

each said first transition assembly, further comprising:

a respective first converter link connected to a last one of said center side ring links and a respective pin link of a plurality of pin links on each respective first and said second side;

a plurality of pull links secured to each said clasp end and extending away from said clasp arrangement to a respective second transition assembly;

each said second transition assembly, further comprising:

a respective second converter link connected to an end of said plurality of pull links; and a last one of said plurality of pin links connected to said second converter link;

a pull link clasp segment on each of said first clasp end and said second clasp end; and said plurality of pull links extending from respective said first clasp end and said second clasp end;

wherein each said pull link, further comprises:

a brace hole on a first pull link contact side; and a cantilever bar arm on a second pull link contact side;

wherein each said first converter link, further comprises:

a cantilever slot brace stub on a first contact side of said converter link; and a convex link contact pivot side surface on a second side surface of said first converter link, wherein each said second converter link, further comprises:

a cantilever bar arm on a first contact side of said second converter link; and a concave link contact pivot side surface on a second side surface of said second converter link;

wherein each said pin link, further comprises:

a convex link contact pivot side surface on a first contact side of said pin link; and a convex link contact pivot side surface on a second contact side of said pin link, wherein each said side ring link, further comprises:

a cantilever slot brace stub on a first ring link contact side; and a cantilever bar arm on a second ring link contact side, wherein said center ring link, further comprises:

a first cantilever slot arm extending from a first contact side of said center ring link; and a second cantilever slot arm extending from a second contact side of said center ring link.

* * * * *